US008115704B2

(12) United States Patent
Smith et al.

(10) Patent No.: US 8,115,704 B2
(45) Date of Patent: Feb. 14, 2012

(54) MULTI-LINE ADDRESSING METHODS AND APPARATUS

(75) Inventors: Euan Christopher Smith, Cambridgeshire (GB); Paul Richard Routley, Cambridge (GB); Jonathan James Michael Halls, Cambridge (GB)

(73) Assignee: Cambridge Display Technology Limited (GB)

( * ) Notice: Subject to any disclaimer, the term of this patent is extended or adjusted under 35 U.S.C. 154(b) by 809 days.

(21) Appl. No.: 10/578,941

(22) PCT Filed: Sep. 29, 2005

(86) PCT No.: PCT/GB2005/050167

§ 371 (c)(1),
(2), (4) Date: May 9, 2006

(87) PCT Pub. No.: WO2006/035246

PCT Pub. Date: Apr. 6, 2006

(65) Prior Publication Data

US 2007/0085779 A1 Apr. 19, 2007

(30) Foreign Application Priority Data

Sep. 30, 2004 (GB) ..... 0421710.5

(51) Int. Cl.
*G09G 3/30* (2006.01)

(52) U.S. Cl. ..... 345/76; 345/82

(58) Field of Classification Search ..... 345/86–12, 345/76; 349/115–117; 340/45–78; 348/275
See application file for complete search history.

(56) References Cited

U.S. PATENT DOCUMENTS

| | | | | |
|---|---|---|---|---|
| 3,621,321 | A | | 11/1971 | Williams et al. |
| 4,539,507 | A | | 9/1985 | VanSlyke et al. |
| 4,672,265 | A | | 6/1987 | Eguchi et al. |
| 5,172,108 | A | * | 12/1992 | Wakabayashi et al. ..... 345/691 |
| 5,247,190 | A | | 9/1993 | Friend et al. |
| 5,646,652 | A | | 7/1997 | Saidi |
| 5,654,734 | A | | 8/1997 | Orlen et al. |

(Continued)

FOREIGN PATENT DOCUMENTS

EP 0541295 A2 5/1993

(Continued)

OTHER PUBLICATIONS

"International Search Report for Application No. PCT/GB2005/050167", 2 Pages.

(Continued)

*Primary Examiner* — Chanh Nguyen
*Assistant Examiner* — Robert Stone
(74) *Attorney, Agent, or Firm* — Schwegman, Lundberg & Woessner, P.A.

(57) ABSTRACT

A method of driving an emissive display, the display comprising a plurality of pixels each addressable by a row electrode and a column electrode, the method comprising: driving a plurality of the column electrodes with a first set of column drive signals; and driving two or more of the row electrodes with a first set of forward bias row drive signals at the same time as the column electrode driving with the column drive signals; then driving the plurality of column electrodes with a second and subsequent sets of column drive signals; and driving the two or more row electrodes with a second and subsequent sets of forward bias row drive signals at the same time as the column electrode driving with the second column drive signals.

23 Claims, 17 Drawing Sheets

U.S. PATENT DOCUMENTS

| | | | | |
|---|---|---|---|---|
| 5,684,502 | A | 11/1997 | Fukui et al. | |
| 5,747,182 | A | 5/1998 | Friend et al. | |
| 5,807,627 | A | 9/1998 | Friend et al. | |
| 5,821,690 | A | 10/1998 | Martens et al. | |
| 5,874,932 | A | 2/1999 | Nagaoka et al. | |
| 5,886,755 | A | 3/1999 | Imoto et al. | |
| 5,900,856 | A * | 5/1999 | Iino et al. | 345/100 |
| 5,965,901 | A | 10/1999 | Heeks et al. | |
| 6,014,119 | A | 1/2000 | Staring et al. | |
| 6,054,974 | A | 4/2000 | Sakai et al. | |
| 6,151,414 | A | 11/2000 | Lee et al. | |
| 6,201,520 | B1 | 3/2001 | Iketsu et al. | |
| 6,332,661 | B1 | 12/2001 | Yamaguchi | |
| 6,366,026 | B1 * | 4/2002 | Saito et al. | 315/169.3 |
| 6,376,994 | B1 | 4/2002 | Ochi et al. | |
| 6,429,601 | B1 | 8/2002 | Friend et al. | |
| 6,496,168 | B1 | 12/2002 | Tomida | |
| 6,498,438 | B1 | 12/2002 | Edwards | |
| 6,501,226 | B2 * | 12/2002 | Lai et al. | 315/169.1 |
| 6,531,827 | B2 | 3/2003 | Kawashima | |
| 6,558,219 | B1 | 5/2003 | Burroughes et al. | |
| 6,558,818 | B1 | 5/2003 | Samuel et al. | |
| 6,605,823 | B1 | 8/2003 | Pichler et al. | |
| 6,678,319 | B1 | 1/2004 | Jamali | |
| 6,771,235 | B2 * | 8/2004 | Ishizuka et al. | 345/77 |
| 6,788,298 | B2 | 9/2004 | Kota et al. | |
| 6,806,857 | B2 * | 10/2004 | Sempel et al. | 345/92 |
| 6,832,729 | B1 | 12/2004 | Perry et al. | |
| 6,897,473 | B1 | 5/2005 | Burroughes et al. | |
| 6,980,182 | B1 | 12/2005 | Nimmer et al. | |
| 7,049,010 | B1 | 5/2006 | Holmes et al. | |
| 7,078,251 | B2 | 7/2006 | Burroughes et al. | |
| 7,125,952 | B2 | 10/2006 | O'Dell et al. | |
| 7,151,341 | B2 | 12/2006 | Pichler et al. | |
| 7,327,358 | B2 * | 2/2008 | Tajiri et al. | 345/208 |
| 7,944,410 | B2 | 5/2011 | Smith et al. | |
| 2001/0040536 | A1 * | 11/2001 | Tajima et al. | 345/55 |
| 2001/0048410 | A1 | 12/2001 | Nishigaki et al. | |
| 2002/0024513 | A1 | 2/2002 | Kota et al. | |
| 2002/0033782 | A1 * | 3/2002 | Ogusu et al. | 345/76 |
| 2002/0054266 | A1 * | 5/2002 | Nishimura | 349/149 |
| 2002/0063671 | A1 | 5/2002 | Knapp | |
| 2002/0083655 | A1 | 7/2002 | Paul et al. | |
| 2002/0097211 | A1 * | 7/2002 | Yasunishi et al. | 345/89 |
| 2002/0158832 | A1 | 10/2002 | Park et al. | |
| 2003/0018604 | A1 | 1/2003 | Franz et al. | |
| 2003/0030608 | A1 * | 2/2003 | Kurumisawa et al. | 345/87 |
| 2003/0048238 | A1 * | 3/2003 | Tsuge et al. | 345/55 |
| 2003/0107542 | A1 | 6/2003 | Abe et al. | |
| 2003/0128225 | A1 * | 7/2003 | Credelle et al. | 345/694 |
| 2003/0189579 | A1 | 10/2003 | Pope | |
| 2003/0193463 | A1 | 10/2003 | Yamada et al. | |
| 2004/0021654 | A1 | 2/2004 | Mas et al. | |
| 2004/0061672 | A1 | 4/2004 | Page et al. | |
| 2004/0066363 | A1 | 4/2004 | Yamano et al. | |
| 2004/0085270 | A1 | 5/2004 | Kimura | |
| 2004/0125046 | A1 | 7/2004 | Yamazaki et al. | |
| 2004/0145553 | A1 * | 7/2004 | Sala et al. | 345/87 |
| 2004/0150608 | A1 | 8/2004 | Kim et al. | |
| 2004/0169463 | A1 | 9/2004 | Burn et al. | |
| 2004/0174282 | A1 | 9/2004 | Sun et al. | |
| 2004/0207578 | A1 | 10/2004 | Koyama | |
| 2004/0249615 | A1 | 12/2004 | Grzeszczuk et al. | |
| 2005/0021333 | A1 | 1/2005 | Smaragdis | |
| 2005/0024300 | A1 | 2/2005 | Abe et al. | |
| 2005/0057462 | A1 * | 3/2005 | Kota et al. | 345/76 |
| 2005/0093786 | A1 | 5/2005 | Kim | |
| 2005/0110720 | A1 * | 5/2005 | Akimoto et al. | 345/76 |
| 2005/0123053 | A1 | 6/2005 | Cooper et al. | |
| 2005/0140610 | A1 | 6/2005 | Smith et al. | |
| 2005/0190119 | A1 * | 9/2005 | Yamazaki et al. | 345/59 |
| 2005/0218791 | A1 | 10/2005 | Kawase | |
| 2005/0219163 | A1 | 10/2005 | Smith et al. | |
| 2005/0280611 | A1 | 12/2005 | Abe et al. | |
| 2006/0001613 | A1 | 1/2006 | Routley et al. | |
| 2006/0050032 | A1 | 3/2006 | Gunner et al. | |
| 2006/0125732 | A1 | 6/2006 | Haruna et al. | |
| 2006/0191178 | A1 | 8/2006 | Sempel et al. | |
| 2006/0214890 | A1 * | 9/2006 | Morishige et al. | 345/77 |
| 2007/0046603 | A1 | 3/2007 | Smith et al. | |
| 2007/0069992 | A1 | 3/2007 | Smith et al. | |
| 2007/0076869 | A1 | 4/2007 | Mihcak et al. | |
| 2008/0246703 | A1 | 10/2008 | Smith | |
| 2008/0291122 | A1 | 11/2008 | Smith | |
| 2009/0128459 | A1 | 5/2009 | Smith | |
| 2009/0128571 | A1 | 5/2009 | Smith et al. | |

FOREIGN PATENT DOCUMENTS

| | | | |
|---|---|---|---|
| EP | 0581255 | A1 | 2/1994 |
| EP | 0621578 | A | 10/1994 |
| EP | 0678844 | A1 | 10/1995 |
| EP | 1079361 | A | 2/2001 |
| EP | 1079361 | A1 | 2/2001 |
| EP | 1091339 | A2 | 4/2001 |
| EP | 1408479 | A2 | 4/2004 |
| EP | 1457958 | A2 | 9/2004 |
| GB | 2371910 | A | 8/2002 |
| GB | 2381643 | A | 5/2003 |
| GB | P84213 | * | 5/2003 |
| GB | P85906 | * | 7/2003 |
| GB | 2388236 | A1 | 11/2003 |
| GB | 2389952 | | 12/2003 |
| GB | 2389952 | A1 | 12/2003 |
| JP | 10-020809 | | 1/1998 |
| JP | 10-260659 | A | 9/1998 |
| JP | 2002-055654 | A | 2/2002 |
| JP | 2002-072947 | A | 3/2002 |
| JP | 2002-258805 | A | 9/2002 |
| JP | 2002-341842 | A | 11/2002 |
| JP | 2002-342842 | A | 11/2002 |
| JP | 2003-084732 | A | 3/2003 |
| JP | 2003-108082 | A | 4/2003 |
| JP | 2003-186270 | A | 7/2003 |
| JP | 2003-323145 | A | 11/2003 |
| JP | 2004-054234 | A | 2/2004 |
| JP | 2004-133138 | A | 4/2004 |
| WO | WO-9013148 | A1 | 11/1990 |
| WO | WO-94/27276 | A1 | 11/1994 |
| WO | WO-9504986 | A1 | 2/1995 |
| WO | WO-9506400 | A1 | 3/1995 |
| WO | WO-9921935 | A1 | 5/1999 |
| WO | WO-9948160 | A1 | 9/1999 |
| WO | WO-02067343 | A1 | 8/2002 |
| WO | WO-03079322 | A1 | 9/2003 |
| WO | WO-03091983 | A1 | 11/2003 |
| WO | WO03094140 | * | 11/2003 |
| WO | WO-04001707 | A2 | 12/2003 |
| WO | WO-2004003877 | A2 | 1/2004 |
| WO | WO-2006035246 | A1 | 4/2006 |
| WO | WO-2006035248 | A1 | 4/2006 |

OTHER PUBLICATIONS

"United Kingdom Search Report for Application No. GB0421710.5", a corresponding patent application, 1 Page.

PCT Application Serial No. PCT/GB2005/050219, International Search Report mailed Feb. 20, 2008, 3 pgs.

Berry, M. W., et al., "Algorithms and Applications for Approximate Nonnegative Matrix Factorization", *Computational Statistics & Data Analysis*, 52, (2007), 155-173.

Chu, M., et al., "Optimality, Computation, and Interpretation of Nonnegative Matrix Factorizations", [online]. VERSION: Oct. 18, 2004. [retrieved Feb. 6, 2008]. Retrieved from the Internet: <URL: http://www.wfu.edu/{plemmons/papers/chu_ple.pdf>, (2004), 18 pgs.

Eisenbrand, F. , et al., "Algorithms for Longer OLED Lifetime", *Proceedings, 6th Workshop on Experimental Algorithms* (*WEA 2007*), *Lecture Notes in Computer Science*, vol. 4525, (2007), 338-351.

Smith, E. C., "8.3: Total Matrix Addressing (TMA™)", *International Symposium Digest of Technical Papers* (*SID 2007*), (2007), 93-96.

Tropp, J. A., "Literature Survey: Non-Negative Matrix Factorization", [online]. Preprint, University of Texas at Austin. [retrieved Feb. 7, 2008]. Retrieved from the Internet: <URL: http://www.acm.caltech.edu/{jtropp/notes/Tro03-Literature-Survey.pdf>, (2003), 10 pgs.

Lee, Daniel D., et al., "Algorithms for Non-negative Matrix Factorization", *Advances in Neural Information Processing Systems*, vol. 13, (2001), 556-562.
Lee, Daniel D., et al., "Learning the parts of objects by nan-negative matrix factorization", *Nature*, Vol. 401, (Oct. 1991), 788-791.
Lui, Wenguo, et al., "Existing and new algorithms for non-negative matrix factorization", http://www.cs.utexas.edu/users/liuwg/383Cproject/CS_383C_Project.htm, (2002).
Shahnaz, Farial, et al., "Document clustering using nonnegative matrix factorization", *Information Processing and Management*, (2004),14 Pages.
Tangsrirat, W., et al., "FTFN with variable current gain", *Proceedings of IEEE Region 10 International Conference on Electrical and Electronic Technology, 2001. TENCON.*, vol. 1, (2001), 209-212.
Vogt, Frank, et al., "Recent advancements in chemometrics for smart sensors", *Analyst*, vol. 129, (2004), 492-502.
"PCT Application Serial No. PCT/GB2005/050219, Written Opinion Feb. 20, 2008", 17 pgs.
"U.S. Appl. No. 10/578,659 , Non-Final Office Action mailed Nov. 12, 2009", 50 Pgs.
"U.S. Appl. No. 10/578,659, Response filed Mar. 12, 2010 to Non Final Office Action mailed Nov. 12, 2009", 18 pgs.
"U.S. Appl. No. 10/578,659, Response filed Mar. 31, 2009 to Restriction Requirement mailed Feb. 3, 2009", 15 pgs.
"U.S. Appl. No. 10/578,659, Response filed Sep. 16, 2009 to Restriction Requirement mailed Jul. 17, 2009", 14 pgs.
"U.S. Appl. No. 10/578,659, Restriction Requirement mailed Feb. 3, 2009", 7 pgs.
"U.S. Appl. No. 10/578,659, Restriction Requirement mailed Jul. 17, 2009", 6 pgs.
Lee, et al., "Learning the parts of objects by non-negative matrix factorization", (1999).
"U.S. Appl. No. 10/578,659, Notice of Allowance mailed Jun. 24, 2010", 9 pgs.
"U.S. Appl. No. 10/578,786, Final Office Action mailed Oct. 7, 2009", 29 pgs.
"U.S. Appl. No. 10/578,786, Non-Final Office Action mailed on Dec. 8, 2008", 58 pgs.
"U.S. Appl. No. 10/578,786, Preliminary Amendment filed May 9, 2006", 11 pgs.
"U.S. Appl. No. 10/578,786, Response filed Feb. 5, 2010 to Final Office Action mailed Oct. 7, 2009", 18 pgs.
"U.S. Appl. No. 10/578,786, Response filed Apr. 7, 2009 to Non Final Office Action mailed Dec. 8, 2008", 27 pgs.
"U.S. Appl. No. 10/578,659 , Notice of Allowance mailed Jun. 24, 2010", 10 pgs.
"Great Britain Application Serial No. GB0421712.1, Search Report dated Dec. 31, 2004", 1 pg.
"International Application Serial No. PCT/GB2005/050169, International Search Report and Written Opinion mailed Feb. 7, 2006", 6 pgs.
"International Application No. PCT/GB2005/050167, Written Opinion mailed Jan. 17, 2007", 7 pgs.
Guillamet, D., et al., "Non-negative Matrix Factorizeration for Face Recognition", Lecture Notes in Computer Science, vol. 2504/2002—Topics in Artificial Intelligence: 5th Catalonian Conference on AI (CCIA 2002), (2002), 336-344.
Routley, P. R., et al., "Display Driver Circuits", Great Britain Application Serial No. GB20020013989.7, filed Jun. 18, 2002, 56 pgs.
"U.S. Appl. No. 10/578,822 , Non-Final Office Action mailed Jan. 7, 2010", 8 pgs.
"U.S. Appl. No. 10/578,822 , Response filed Nov. 9, 2010 to Final Office Acton mailed Jul. 9, 2010", 9 pgs.
"U.S. Appl. No. 10/578,822 Final Office Action mailed Jul. 9, 2010", 11 pgs.
"U.S. Appl. No. 10/578,822, Reponse Filed Mar. 27, 2009 Non-Final Office Action mailed Dec. 10, 2008", 13 pgs.
"U.S. Appl. No. 10/578,822, Final Office Action mailed Jun. 22, 2009", 7 pgs.
"U.S. Appl. No. 10/578,822, Non-Final Office Action mailed Dec. 10, 2008", 20 pgs.
"U.S. Appl. No. 10/578,822, Preliminary Amendment filed May 9, 2006", 6 pgs.
"U.S. Appl. No. 10/578,822, Response filed Oct. 19, 2009 to Final Office Acton mailed Jun. 22, 2009", 10 pgs.
"U.S. Appl. No. 10/578,822, Response filed Apr. 6, 2010 to Non-Final Office Action mailed Jan. 7, 2010", 8 pgs.
"International Application Serial No. PCT/GB2005/050168, International Search Report mailed Jan. 31, 2006", 4 pgs.
"United Kingdom Search report for Application No. GB0421711.3", 1 Page.
"U.S. Appl. No. 10/578,659, Preliminary Amendment filed May 9, 2006", 14 pgs.
"Japanese Application Serial. No. 2007-534097, Office Action mailed May 24, 2011", (English Translation), 8 pgs.
Yamaguchi, K., et al., "An Initialization Method for Non-negative Matrix Factorization and Its Application", (w/ English Abstract), *IEICE Transactions on Information and Systems, Pt.* 2 (Japanese Edition), vol. J87-D-II, No. 3, (Mar. 2004), 923-928.

* cited by examiner

300

MULTI-LINE ADDRESSING METHODS AND APPARATUS

CLAIM OF PRIORITY

This application is a U.S. National Stage Filing under 35 U.S.C. 371 from International Patent Application No. PCT/GB2005/050167, filed Sep. 29, 2005 and published as WO 2006/035246 A1 on Apr. 6, 2006, which claimed priority under 35 U.S.C. 119 to United Kingdom Application No. 0421710.5, filed Sep. 30, 2004, which applications and publication are incorporated herein by reference and made a part hereof; and applicant hereby claims priority under 35 U.S.C. 119 to Great Britain Application No. GB0501211.7, filed 21Jan. 2005.

This invention relates to methods and apparatus for driving emissive, in particular organic light emitting diodes (OLED) displays using multi-line addressing (MLA) techniques. Embodiments of the invention are particularly suitable for use with so-called passive matrix OLED displays. This application is one of a set of three related applications sharing the same priority date.

BACKGROUND

Multi-line addressing techniques for liquid crystal displays (LCDs) have been described, for example in US2004/150608, US2002/158832 and US2002/083655, for reducing power consumption and increasing the relatively slow response rate of LCDs. However these techniques are not suitable for OLED displays because of differences stemming from the fundamental difference between OLEDs and LCDs that the former is an emissive technology whereas the latter is a form of modulator. Furthermore, an OLED provides a substantially linear response with applied current and whereas an LCD cell has a non-linear response which varies according to the RMS (root-mean-square) value of the applied voltage.

Displays fabricated using OLEDs provide a number of advantages over LCD and other flat panel technologies. They are bright, colourful, fast-switching (compared to LCDs), provide a wide viewing angle and are easy and cheap to fabricate on a variety of substrates. Organic (which here includes organometallic) LEDs may be fabricated using materials including polymers, small molecules and dendrimers, in a range of colours which depend upon the materials employed. Examples of polymer-based organic LEDs are described in WO 90/13148, WO 95/06400 and WO 99/48160; examples of dendrimer-based materials are described in WO 99/21935 and WO 02/067343; and examples of so called small molecule based devices are described in U.S. Pat. No. 4,539,507.

A typical OLED device comprises two layers of organic material, one of which is a layer of light emitting material such as a light emitting polymer (LEP), oligomer or a light emitting low molecular weight material, and the other of which is a layer of a hole transporting material such as a polythiophene derivative or a polyaniline derivative.

Organic LEDs may be deposited on a substrate in a matrix of pixels to form a single or multi-colour pixellated display. A multicoloured display may be constructed using groups of red, green, and blue emitting pixels. So-called active matrix displays have a memory element, typically a storage capacitor and a transistor, associated with each pixel whilst passive matrix displays have no such memory element and instead are repetitively scanned to give the impression of a steady image. Other passive displays include segmented displays in which a plurality of segments share a common electrode and a segment may be lit up by applying a voltage to its other electrode. A simple segmented display need not be scanned but in a display comprising a plurality of segmented regions the electrodes may be multiplexed (to reduce their number) and then scanned.

FIG. Ia shows a vertical cross section through an example of an OLED device 100. hi an active matrix display part of the area of a pixel is occupied by associated drive circuitry (not shown in FIG. Ia). The structure of the device is somewhat simplified for the purposes of illustration.

The OLED 100 comprises a substrate 102, typically 0.7 mm or 1.1 mm glass but optionally clear plastic or some other substantially transparent material. An anode layer 104 is deposited on the substrate, typically comprising around 150 run thickness of ITO (indium tin oxide), over part of which is provided a metal contact layer. Typically the contact layer comprises around 500 nm of aluminium, or a layer of aluminium sandwiched between layers of chrome, and this is sometimes referred to as anode metal. Glass substrates coated with ITO and contact metal are available from Coming, USA. The contact metal over the ITO helps provide reduced resistance pathways where the anode connections do not need to be transparent, in particular for external contacts to the device. The contact metal is removed from the ITO where it is not wanted, in particular where it would otherwise obscure the display, by a standard process of photolithography followed by etching.

A substantially transparent hole transport layer 106 is deposited over the anode layer, followed by an electroluminescent layer 108, and a cathode 110. The electroluminescent layer 108 may comprise, for example, a PPV (poly (p~phenylenevi πylene)) and the hole transport layer 106, which helps match the hole energy levels of the anode layer 104 and electroluminescent layer 108, may comprise a conductive transparent polymer, for example PEDOT:PSS (polystyrene-sulphonate-doped polyethylene-dioxythiophene) from Bayer AG of Germany. In a typical polymer-based device the hole transport layer 106 may comprise around 200 πm of PEDOT; a light emitting polymer layer 108 is typically around 70 nm in thickness. These organic layers may be deposited by spin coating (afterwards removing material from unwanted areas by plasma etching or laser ablation) or by inkjet printing. In this latter case banks 112 may be formed on the substrate, for example using photoresist, to define wells into which the organic layers may be deposited. Such wells define light emitting areas or pixels of the display.

Cathode layer 110 typically comprises a low work function metal such as calcium or barium (for example deposited by physical vapour deposition) covered with a thicker, capping layer of aluminium. Optionally an additional layer may be provided immediately adjacent the electroluminescent layer, such as a layer of lithium fluoride, for improved electron energy level matching. Mutual electrical isolation of cathode lines may achieved or enhanced through the use of cathode separators (not shown in FIG. Ia).

The same basic structure may also be employed for small molecule and dendrimer devices. Typically a number of displays are fabricated on a single substrate and at the end of the fabrication process the substrate is scribed, and the displays separated before an encapsulating can is attached to each to inhibit oxidation and moisture ingress.

To illuminate the OLED power is applied between the anode and cathode, represented in FIG. Ia by battery 118. In the example shown in FIG. Ia light is emitted through transparent anode 104 and substrate 102 and the cathode is generally reflective; such devices are referred to as "bottom emitters". Devices which emit through the cathode ("top emitters") may also be constructed, for example by keeping the thickness of cathode layer 110 less than around 50-100 run so that the cathode is substantially transparent.

Organic LEDs may be deposited on a substrate in a matrix of pixels to form a single or multi-colour pixellated display. A multicoloured display may be constructed using groups of red, green, and blue emitting pixels. In such displays the individual elements are generally addressed by activating row (or column) lines to select the pixels, and rows (or columns) of pixels are written to, to create a display. So-called active matrix displays have a memory element, typically a storage capacitor and a transistor, associated with each pixel whilst passive matrix displays have no such memory element and instead are repetitively scanned, somewhat similarly to a TV picture, to give the impression of a steady image.

Referring now to FIG. 1*b*, this shows a simplified cross-section through a passive matrix OLED display device 150, in which like elements to those of FIG. Ia are indicated by like reference numerals. As shown the hole transport 106 and electroluminescent 108 layers are subdivided into a plurality of pixels 152 at the intersection of mutually perpendicular anode and cathode lines defined in the anode metal 104 and cathode layer 110 respectively. In the figure conductive lines 154 defined in the cathode layer 110 run into the page and a cross-section through one of a plurality of anode lines 158 running at right angles to the cathode lines is shown. An electroluminescent pixel 152 at the intersection of a cathode and anode line may be addressed by applying a voltage between the relevant lines. The anode metal layer 104 provides external contacts to the display 150 and may be used for both anode and cathode connections to the OLEDs (by running the cathode layer pattern over anode metal lead-outs). The above mentioned OLED materials, in particular the light emitting polymer and the cathode, are susceptible to oxidation and to moisture and the device is therefore encapsulated in a metal can 111, attached by UV-curable epoxy glue 113 onto anode metal layer 104, small glass beads within the glue preventing the metal can touching and shorting out the contacts.

Referring now to FIG. 2, this shows, conceptually, a driving arrangement for a passive matrix OLED display 350 of the type shown in FIG. Ib. A plurality of constant current generators 200 are provided, each connected to a supply line 202 and to one of a plurality of column lines 204, of which for clarity only one is shown. A plurality of row lines 206 (of which only one is shown) is also provided and each of these may be selectively connected to a ground line 208 by a switched connection 210. As shown, with a positive supply voltage on line 202, column lines 204 comprise anode connections 158 and row lines 206 comprise cathode connections 354, although the connections would be reversed if the power supply line 202 was negative and with respect to ground line 208.

As illustrated pixel 212 of the display has power applied to it and is therefore illuminated. To create an image connection 210 for a row is maintained as each of the column lines is activated in turn until the complete row has been addressed, and then the next row is selected and the process repeated. Preferably, however, to allow individual pixels to remain on for longer and hence reduce overall drive level, a row is selected and all the columns written in parallel, that is a current driven onto each of the column lines simultaneously to illuminate each pixel in a row at its desired brightness. Each pixel in a column could be addressed in turn before the next column is addressed but this is not preferred because, inter alia, of the effect of column capacitance. The skilled person will appreciate that in a passive matrix OLED display it is arbitrary which electrodes are labelled row electrodes and which column electrodes, and in this specification "row" and "column are used interchangeably.

It is usual to provide a current-controlled rather than a voltage-controlled drive to an OLED because the brightness of an OLED is determined by the current flowing through the device, this determining the number of photons it generates. In a voltage-controlled configuration the brightness can vary across the area of a display and with time, temperature, and age, making it difficult to predict how bright a pixel will appear when driven by a given voltage. In a colour display the accuracy of colour representations may also be affected.

The conventional method of varying pixel brightness is to vary pixel on-time using Pulse Width Modulation (PWM). In a conventional PWM scheme a pixel is either full on or completely off but the apparent brightness of a pixel varies because of integration within the observer's eye. An alternative method is to vary the column drive current.

FIG. 3 shows a schematic diagram 300 of a generic driver circuit for a passive matrix OLED display according to the prior art. The OLED display is indicated by dashed line 302 and comprises a plurality n of row lines 304 each with a corresponding row electrode contact 306 and a plurality m of column lines 308 with a corresponding plurality of column electrode contacts 310. An OLED is connected between each pair of row and column lines with, in the illustrated arrangement, its anode connected to the column line. A y-driver 314 drives the column lines 308 with a constant current and an x-driver 316 drives the row lines 304, selectively connecting the row lines to ground. The y-driver 314 and x-driver 316 are typically both under the control of a processor 318. A power supply 320 provides power to the circuitry and, in particular, to y-driver 314.

Some examples of OLED display drivers are described in U.S. Pat. Nos. 6,014,1 19, 6,201,520, 6,332,661, EP 1,079, 361A and EP 1,091 ,339A and OLED display driver integrated circuits employing PWM are sold by Clare Micronix of Clare, Inc., Beverly, Mass., USA. Some examples of improved OLED display drivers are described in the Applicant 's co-pending applications WO 03/079322 and WO 03/091983. In particular WO 03/079322, hereby incorporated by reference, describes a digitally controllable programmable current generator with improved compliance.

OVERVIEW

There is a continuing need for techniques which can improve the lifetime of an OLED display. There is a particular need for techniques which are applicable to passive matrix displays since these are very much cheaper to fabricate than active matrix displays. Reducing the drive level (and hence brightness) of an OLED can significantly enhance the lifetime of the device—for example halving the drive/brightness of the OLED can increase its lifetime by approximately a factor of four. The inventors have recognised that multi-line addressing techniques can be employed to reduce peak display drive levels, in particular in passive matrix OLED displays, and hence increase display lifetime.

According to a first aspect of the present invention there is therefore provided a method of driving an emissive, in particular display, the display comprising a plurality of pixels each addressable by a row electrode and a column electrode, the method comprising: driving a plurality of said column electrodes with a first set of column drive signals; and driving two or more of said row electrodes with a first set of row drive signals at the same time as said column electrode driving with said column drive signals; then driving said plurality of column electrodes with a second set (and optionally subsequent sets) of column drive signals; and driving said two or more row electrodes with a second set (and optionally subsequent sets) of row drive signals at the same time as said column electrode driving with said second (and optionally subsequent) column drive signals.

Embodiments of this method cause a plurality of pixels in each of two or more rows of the display to emit light at the same time and hence enable a reduction of the peak brightness of OLED pixels of the display, hence extending the lifetime of the display. Also there is also a reduction in power consumption due to a reduction of drive voltage and reduced capacitive losses.

Broadly speaking by driving groups of rows and columns simultaneously, rather than in sequence as in a conventional drive scheme, advantage may be taken of correlations between the luminescence of pixels in different rows so that the required luminescence profiles of each row (line) are built up over a plurality of line scan periods rather than as an impulse in a single line scan period (although in embodiments the same total number of line scan periods may be employed—for example three periods for three lines).

By building up the luminescence profiles over a plurality of line scan periods the pixel drive during each line scan period can be reduced. The degree of reduction depends upon the correlation between the groups of lines driven together, and preferably therefore groups of two or more rows (lines) are selected based upon their correlation or expected correlation. For example in a "Windows" (trademark) type display many of the lines have correlated values; likewise the same is true of lines of pixels making up text (consider, for example, the diagonal strokes in the letter "A").

In other arrangements the row electrodes which are grouped together and driven at the same time may comprise electrodes of a primary colour sub-pixels of a display with colour pixels. Generally there is a relatively high correlation between say, red, green and blue subpixels of a colour pixel because these all contribute to an overall luminescence of the colour pixel.

Preferably the first and second column drive signals and the first and second row drive signals are selected such that a desired luminescence of OLED pixels (or sub-pixels) driven by the row and column electrodes is obtained by a substantially linear sum of luminescences determined by the first row and column drive signals and luminescences determined by the second row and column drive signals. Where three row electrodes are driven together the method comprises three steps of driving the row and column electrodes with respective first, second and third sets of row/column drive signals.

Where the contribution of a set of row drive signals to the overall desired luminescence of OLED pixels driven by the row and column electrodes is small, that is where the contribution of a set of a row/column drive signals to the aforementioned linear sum is small, the contribution may be neglected and the corresponding row/column driving steps omitted. In this way the effective frame rate may be increased (since the total number of line scan periods is reduced) thus increasing the apparent brightness of the display to the (integrating) human eye and thus allowing a further reduction in peak drive signals. This may be taken into account when determining row and column drive signals for the aforementioned linear sum.

Likewise when two or more rows of pixels have substantially the same desired luminescence for most or all of the pixels in the rows only a single, common set of row drive signals need be applied and a second set of row and column drive signals for the two or more rows may be omitted; this also has the effect of increasing the frame rate or, equivalently, allowing a lengthening of the line period for the same overall frame rate.

Preferably the first and second row and column drive signals comprise current drive signals since an OLED has a substantially linear response to such a current drive, facilitating determination of suitable row and column drive signals when two or more rows are driven together. Such a current drive signal may conveniently be provided by a (controllable) constant current generator which may comprise a current source or a current sink. Additionally or alternatively the first and second row and column drive signals may comprise pulse width modulated drive signals; in general any variable which can modify an OLED brightness may be employed to vary the row/column drives.

As described above, in embodiments the first and second row and column drive signals are selected such that a peak luminescence of a driven pixel is less than it would be were the row electrodes to be driven separately. The simultaneously driven pixel rows may comprise adjacent lines of pixels on the display or may comprise rows which have been grouped in groups of two, three or more because of their relatively increased correlation with one another. For example where dithering is in frequent use a set of two or more alternate rows may be simultaneously addressed.

The principle can be extended in the case of video to group rows in the time domain, additionally or alternatively to the spatial domain—that is the grouped rows may comprise the same row in successively displayed image frames, building up the desired luminescence profile over a plurality of successive frames.

Whether a pulse width modulated and/or variable current drive is employed the effect of driving a set of column electrodes at the same time as driving two or more row electrodes with a set of row drive signals is to divide the column drive between the rows in accordance with a ratio defined by the row drive signals, hi other words the proportion of drive signal applied to each row determines the proportions of a common column drive signal each row receives.

In the above described methods it will be appreciated that the roles of the row and column drive signals may be exchanged. Embodiments of the method are particularly useful for passive matrix displays, although they may also be employed with active matrix displays.

The invention also provides an emissive, in particular OLED display driver comprising means to implement embodiments of the above described method. Such means may comprise discrete components and/or one or more integrated circuits, or an ASIC (Applications Specific Integrated Circuits) or an FPGA (Field Programmable Gate Array), or a dedicated processor with appropriate processor control code (or microcode) or any combination of these.

Thus the invention also provides an emissive, in particular OLED display driver for driving an emissive display comprising a plurality of pixels each addressable by a row electrode and a column electrode, said display driver comprising: means for driving a plurality of said column electrodes with a first set of column drive signals; means for driving two or more of said row electrodes with a first set of row drive signals at the same time as said column electrode driving with said first column drive signals; means for driving said plurality of column electrodes with a second set of column drive signals; and means for driving said two or more row electrodes with a second set of row drive signals at the same time as said column electrode driving with said second column drive signals.

The invention further provides an emissive, in particular OLED display driver circuit for driving an emissive, in particular OLED display, pixels (OLEDs) of the display being addressed by row electrodes and corresponding column electrodes, said display driver comprising: one or more column drivers to simultaneously drive a plurality of said column electrodes; and one or more row drivers to simultaneously drive a plurality of said row electrodes corresponding to said column electrodes at the same time as said column electrode driving, such that a drive for a said column electrode is shared between a plurality of said row drivers.

Preferably the row and column drivers comprise substantially constant current generators (sources or sinks); these may be controllable or programmable by means of a digital-to-analogue converter.

The invention further provides processor control code, and a carrier medium carrying the code to implement the above described methods and display drivers. This code may comprise conventional program code, for example for a digital signal processor (DSP), or microcode, or code for setting up or controlling an ASIC or FPGA, or code for a hardware description language such as Verilog (trademark); such code may be distributed between a plurality of coupled components. The carrier medium may comprise any conventional storage medium such as a disk or programmed memory such as firmware.

In a further aspect the invention provides an integrated circuit die chip comprising a plurality of drivers configured to drive a plurality of electrodes of an OLED display simultaneously, and display drive processing circuitry configured to determine drive signals for said plurality of electrodes; and wherein said die has an aspect ratio of greater than 10 to 1, length to breadth, preferably greater than 15:1.

The inventors have recognised that display drive processing circuitry may be incorporated into a conventional driver chip with little or no increase in silicon area. This is because driver chips are generally physically configured as a long line of substantially identical drivers but since there is a minimum physical width to which a chip can be diced a relatively large virtually unused dead space is frequently present. For example a die for a driver chip may have a length of 20 mm and hence a minimum width of approximately 1 mm. The inventors have recognized that with such a long, thin physical configuration of a driver chip this space can be efficiently utilized to implement processing circuitry for assisting performance of embodiments of above described method.

More particularly, as is described further later, preferred embodiments of the method may be implemented by means of a calculation involving a matrix calculations. Such matrix calculations may be implemented by means of conventional signal processing blocks from a suitable library of what is generally known as "intellectual property" in a manner well known to those skilled in the art, using one or both edges of the driver integrated circuit die with little or no impact on chip fabrication cost if the extra silicon required does not exceed the available "dead space". This may be facilitated by limiting implemented embodiments of the method to between two and four or, say, no more than six simultaneously driven rows.

A multicolour display in accordance with aspects of the invention may also be provided by employing white-emitting sub-pixels with colour filters.

The invention also provides a multi-colour organic electro-luminescent display comprising a matrix of pixels, each pixel having at least three sub-pixels, wherein a first sub-pixel comprises a sub-pixel of a first colour, a second sub-pixel comprises a sub-pixel of a second colour and a third sub-pixel comprises a sub-pixel of a third colour overlapping said first colour and said second colour or comprising a mix of the first and second colours and optionally an additional colour.

Preferably the third sub-pixel comprises a sub-pixel configured to emit light within the gamut of the first and second sub-pixels. A fourth sub-pixel of a fourth colour (e.g. a mix of the first, second and third colours and optionally an additional colour) may also be included. The third sub-pixel may comprise a white sub-pixel and/or may be configured to emit light within the gamut of the first, second and fourth sub-pixels (that is, the third sub-pixel may have a colour overlapping the first, second and fourth colours and/or emit at a wavelength overlapping wavelengths emitted by the first, second, and fourth sub-pixels). All the sub-pixels may have substantially the same area or the third sub-pixel may have a larger area than the other sub-pixels.

The invention further provides a method of providing a multi-colour organic electro-luminescent display with an increased lifetime, the display comprising a matrix of pixels, each pixel having at least three sub-pixels, wherein a first sub-pixel comprises a sub-pixel of a first colour, a second sub-pixel comprises a sub-pixel of a second colour and a third sub-pixel comprises a sub-pixel of a third colour overlapping said first colour and said second colour or comprising a mix of the first and second colours and optionally an additional colour, the method comprising determining the light output of the third sub-pixel as a component of the light output of the first sub-pixel and a component of the light output of the second sub-pixel, determining the maximum portion of light output emitable for a given colour using said third sub-pixel and subtracting the corresponding light output components from the first sub-pixel light output and the second sub-pixel light output.

Embodiments of the above described display and method, by the incorporation of additional coloured sub-pixels into each coloured pixel, allow a combination of improved lifetime, increased colour gamut, and reduced power consumption. In particular the incorporation of a white pixel significantly reduces the demands on the blue pixels (which have the shortest lifetimes) when displaying a predominantly white background. This facilitates increased display lifetimes because a white emitting OLED can have a substantially longer lifetime than a blue OLED of equivalent light output to generate the same white brightness. The incorporation of sub-pixels of other colours, for example cyan, magenta, and/or yellow in embodiments allows a greater area of the colour gamut to be accessed. This is advantageous, for example, for specialist displays such as are employed in the graphic arts.

BRIEF DESCRIPTION OF THE DRAWINGS

These and other aspects of the invention will now be further described, by way of example only, with the reference to the accompanying figures in which.

DETAILED DESCRIPTION

Figure 1A:
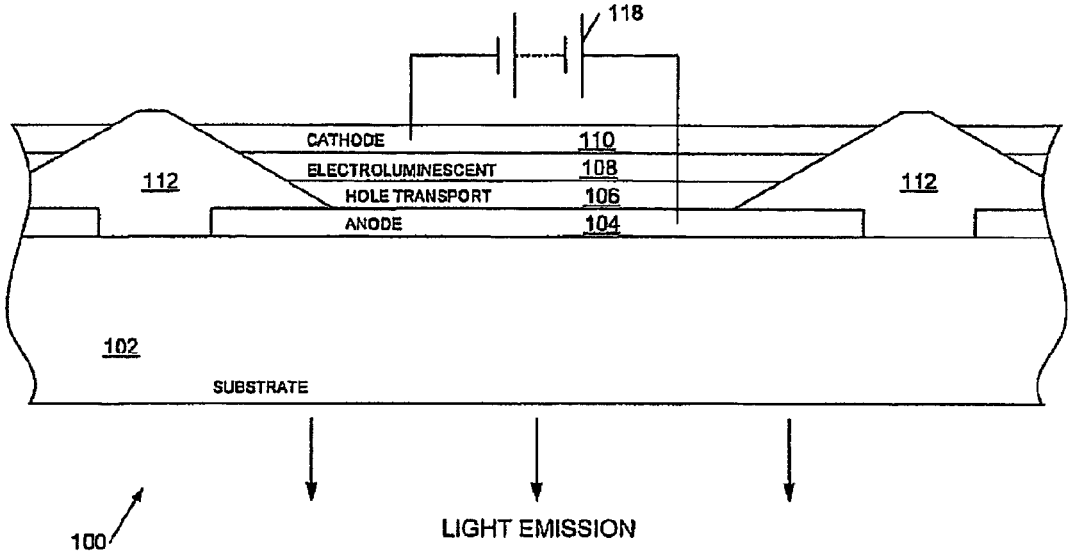
FIGS. 1*a* and 1*b* show, respectively, a vertical cross section through an OLED device, and a simplified cross section through a passive matrix OLED display.
Figure 1B:
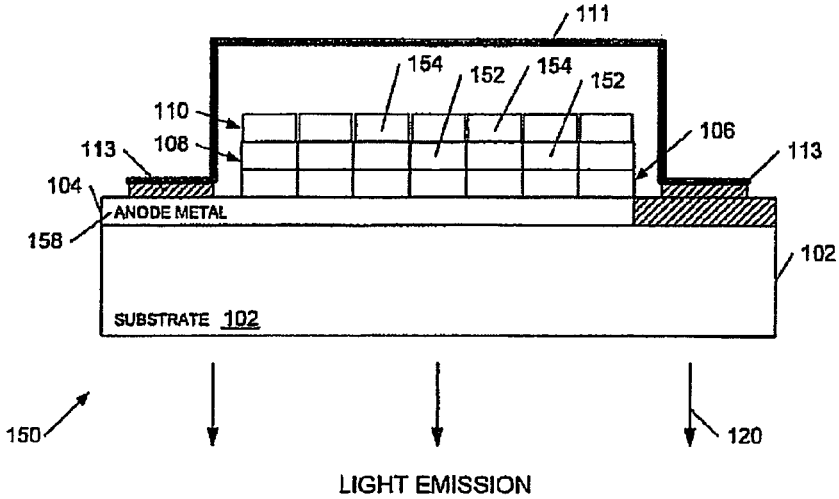
Figure 2:
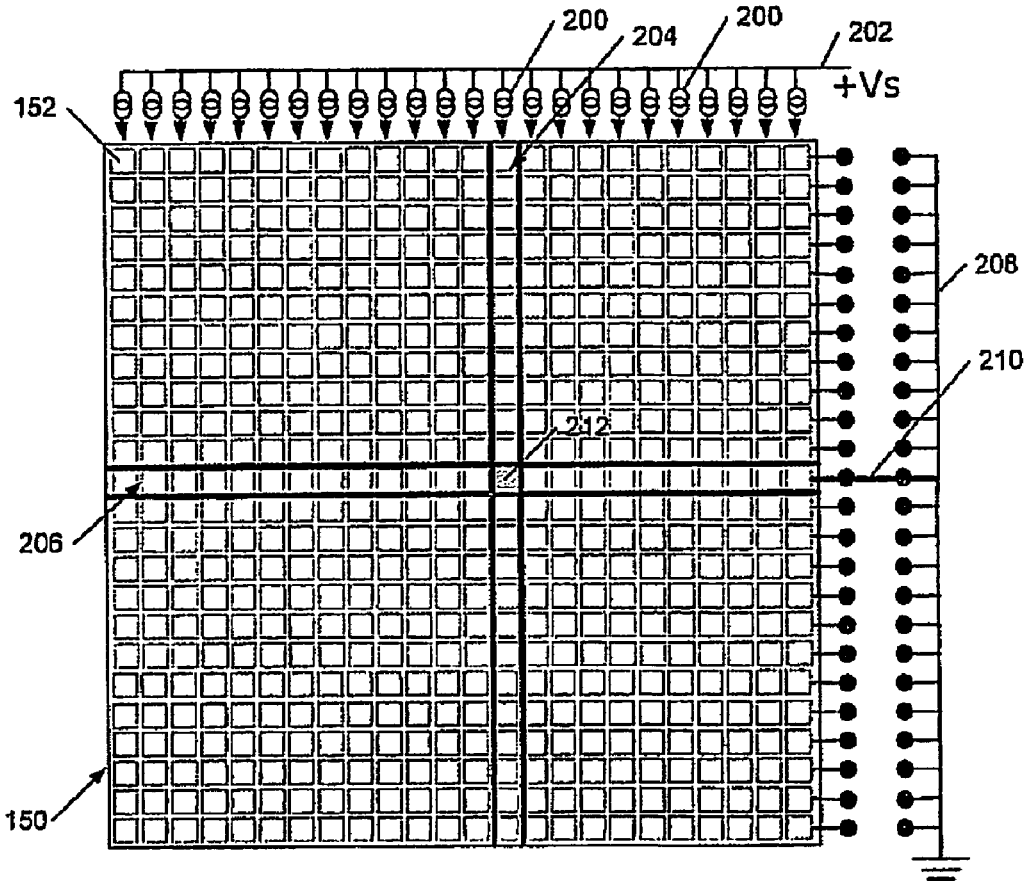
FIG. 2 shows conceptually a driving arrangement for a passive matrix OLED display.

Consider a pair of rows of a passive matrix OLED display comprising a first row A, and a second row B. In a conventional passive matrix drive scheme the rows would be driven as shown in table 1 below, with each row in either a fully-on state (1.0) or a fully-off state (0.0).

TABLE 1

| A | | B | |
|---|---|---|---|
| on | (1.0) | off | (0.0) |
| off | (0.0) | on | (1.0) |

Consider the ratio A/(A+B); in the example of Table 1 above this is either zero or one, but provided that a pixel in the same column in the two rows is not fully-on in both rows tiiis ratio may be reduced whilst still providing the desired pixel luminances. In this way the peak drive level can be reduced and pixel lifetime increased.

In the first line scan the luminances might be:

| First period | | | | |
|---|---|---|---|---|
| 0.0 | 0.361 | 0.650 | 0.954 | 0.0 |
| 0.0 | 0.015 | 0.027 | 0.039 | 0.0 |
| Second period | | | | |
| 0.2 | 0.139 | 0.050 | 0.046 | 0.0 |
| 0.7 | 0.485 | 0.173 | 0.161 | 0.0 |

It can be seen that:

1. Ratios between the two rows are equal in a single scan period (0.96 for the first scan period, 0.222 for the second).
2. Luminances between the two rows add up to the required values.
3The peak luminances are equal or less than those during a standard scan.

The example above demonstrates the technique in a simple two line case. If the ratios in the luminance data are similar between the two lines then more benefit is obtained. Depending upon the type of calculations on image data, luminances can be reduced by an average of 30 percent or more, which can have a significant beneficial effect on pixel lifetime. Expanding the technique to consider more rows simultaneously can provide greater benefit.

An example of multiline addressing using SVD image matrix decomposition is given below.

We describe the driving system as matrix multiplication where I is, an image matrix (bit map file), D the displayed image (should be the same as I), R the row drive matrix and C the column drive matrix. The Columns of R describe the drive to the rows in line periods' and the Rows or R represent the rows driven. The one row at a time system is thus an identity matrix. For a 6×4 display chequer board display:

$$D(R, C) := R \cdot C$$

$$I := \begin{pmatrix} 1 & 0 & 1 & 0 & 1 & 0 \\ 0 & 1 & 0 & 1 & 0 & 1 \\ 1 & 0 & 1 & 0 & 1 & 0 \\ 0 & 1 & 0 & 1 & 0 & 1 \end{pmatrix}$$

$$C := 1$$

$$R := \begin{pmatrix} 1 & 0 & 0 & 0 \\ 0 & 1 & 0 & 0 \\ 0 & 0 & 1 & 0 \\ 0 & 0 & 0 & 1 \end{pmatrix}$$

$$R \cdot C = \begin{pmatrix} 1 & 0 & 1 & 0 & 1 & 0 \\ 0 & 1 & 0 & 1 & 0 & 1 \\ 1 & 0 & 1 & 0 & 1 & 0 \\ 0 & 1 & 0 & 1 & 0 & 1 \end{pmatrix}$$

which is the same as the image.

Now consider using a two frame drive method:

$$C := \begin{pmatrix} 1 & 0 & 1 & 0 & 1 & 0 \\ 0 & 1 & 0 & 1 & 0 & 1 \end{pmatrix}$$

$$R := \begin{pmatrix} 1 & 0 \\ 0 & 1 \\ 1 & 0 \\ 0 & 1 \end{pmatrix}$$

$$R \cdot C := \begin{pmatrix} 1 & 0 & 1 & 0 & 1 & 0 \\ 0 & 1 & 0 & 1 & 0 & 1 \\ 1 & 0 & 1 & 0 & 1 & 0 \\ 0 & 1 & 0 & 1 & 0 & 1 \end{pmatrix}$$

Again this is the same as the Image matrix.

The drive matrix can be calculated by using Singular Value Decomposition as follows (using MathCad nomenclature):

$X$:=svd($1^T$)(gives $U$ and $V$)

$Y$:=svds($1^T$)(gives $S$as a vector of the diagonal elements)

Note Y has only two elements, ie two frames:

$$Y = \begin{pmatrix} 2.449 \\ 2.449 \\ 0 \\ 0 \end{pmatrix}$$

$U$:=submatrix($X$,0,5,0,3)(ie top 6 rows)

$V$:=submatrix($X$,6,9,0,3)$^T$(ie lower 4 rows)

| | | 0 | 1 | 2 | 3 |
|---|---|---|---|---|---|
| X= | 0 | 0.577 | 0 | 0.816 | 0 |
| | 1 | 0 | 0.577 | 0 | 0.816 |
| | 2 | 0.577 | 0 | −0.408 | $4.57 \cdot 10^{-14}$ |
| | 3 | 0 | 0.577 | 0 | −0.408 |
| | 4 | 0.577 | 0 | −0.408 | $-4.578 \cdot 10^{-14}$ |
| | 5 | 0 | 0.577 | 0 | −0.408 |
| | 6 | 0.707 | 0 | 0.707 | 0 |
| | 7 | 0 | 0.707 | 0 | −0.707 |
| | 8 | 0.707 | 0 | −0.707 | 0 |
| | 9 | 0 | 0.707 | 0 | 0.707 |

$w$:=diag($Y$)(ie. Format $Y$ as a diagonal matrix)

$$W = \begin{pmatrix} 2.449 & 0 & 0 & 0 \\ 0 & 2.449 & 0 & 0 \\ 0 & 0 & 0 & 0 \\ 0 & 0 & 0 & 0 \end{pmatrix}$$

$$D := (U - W - V)^T$$

Checking D;

$$D = \begin{pmatrix} 1 & 0 & 1 & 0 & 1 & 0 \\ 0 & 1 & 0 & 1 & 0 & 1 \\ 1 & 0 & 1 & 0 & 1 & 0 \\ 0 & 1 & 0 & 1 & 0 & 1 \end{pmatrix}$$

$$R := (W \cdot V)^T$$

$$R = \begin{pmatrix} 1.732 & 0 & 0 & 0 \\ 0 & 1.732 & 0 & 0 \\ 1.732 & 0 & 0 & 0 \\ 0 & 1.732 & 0 & 0 \end{pmatrix}$$

(Note the empty last 2 columns)

$R$:=submatrix($R$,0,3,0,1)(select the non-empty columns)

$$R = \begin{pmatrix} 1.732 & 0 \\ 0 & 1.732 \\ 1.732 & 0 \\ 0 & 1.732 \end{pmatrix}$$

$$C := U^T$$

-continued $$C = \begin{pmatrix} 0.577 & 0 & 0.577 & 0 & 0.577 & 0 \\ 0 & 0.577 & 0 & 0.577 & 0 & 0.577 \\ 0.816 & 0 & -0.408 & 0 & -0.408 & 0 \\ 0 & 0.816 & 4.57 \times 10^{-14} & -0.408 & -4.578 \times 10^{-14} & -0.408 \end{pmatrix}$$

(As we reduced R so C is reduced to top rows only)

$$C := \text{submatrix}(C, 0, 1, 0, 5)$$

$$C = \begin{pmatrix} 0.577 & 0 & 0.577 & 0 & 0.577 & 0 \\ 0 & 0.577 & 0 & 0.577 & 0 & 0.577 \end{pmatrix}$$

$$R \cdot C = \begin{pmatrix} 1 & 0 & 1 & 0 & 1 & 0 \\ 0 & 1 & 0 & 1 & 0 & 1 \\ 1 & 0 & 1 & 0 & 1 & 0 \\ 0 & 1 & 0 & 1 & 0 & 1 \end{pmatrix}$$

Which is the same as the desired image.

Now consider a more general case, an image of the letter "A":

$$I := \begin{pmatrix} 0 & 0 & 1 & 1 & 0 & 0 \\ 0 & 1 & 0 & 0 & 1 & 0 \\ 1 & 1 & 1 & 1 & 1 & 1 \\ 1 & 0 & 0 & 0 & 0 & 1 \end{pmatrix}$$

$$X := svd(I^T)$$

$$Y := svds(I^T)$$

(Note Y has only two elements, ie three frames)

$$Y = \begin{pmatrix} 2.828 \\ 1.414 \\ 1.414 \\ 0 \end{pmatrix}$$

$$U := \text{submatrix}(X, 0, 5, 0, 3)$$

$$V := \text{submatrix}(X, 6, 9, 0, 3)^T$$

$$W := diag(Y)$$

$$D := (U \cdot W \cdot V)^T$$

$$D = \begin{pmatrix} 0 & 0 & 1 & 1 & 0 & 0 \\ 0 & 1 & 0 & 0 & 1 & 0 \\ 1 & 1 & 1 & 1 & 1 & 1 \\ 1 & 0 & 0 & 0 & 0 & 1 \end{pmatrix}$$

(Checking D)

$$R := (W \cdot V)^T$$

$$R = \begin{pmatrix} -0.816 & 1.155 & 0 & 0 \\ -0.816 & -0.577 & 1 & 0 \\ -2.449 & 0 & 0 & 0 \\ -0.816 & -0.577 & -1 & 0 \end{pmatrix}$$

(Note empty last columns).

$$R := \text{submatrix}(R, 0, 3, 0, 2)$$

$$V = \begin{pmatrix} -0.289 & -0.289 & -0.866 & -0.289 \\ 0.816 & -0.408 & 0 & -0.408 \\ 0 & 0.707 & 0 & -0.707 \\ 0.5 & 0.5 & -0.5 & 0.5 \end{pmatrix}$$

$$R = \begin{pmatrix} -0.816 & 1.155 & 0 \\ -0.816 & -0.577 & 1 \\ -2.449 & 0 & 0 \\ -0.816 & -0.577 & -1 \end{pmatrix}$$

$$C := U^T$$

$$W = \begin{pmatrix} 2.828 & 0 & 0 & 0 \\ 0 & 1.414 & 0 & 0 \\ 0 & 0 & 1.414 & 0 \\ 0 & 0 & 0 & 0 \end{pmatrix}$$

$$C = \begin{pmatrix} -0.408 & -0.408 & -0.408 & -0.408 & -0.408 & -0.408 \\ -0.289 & -0.289 & 0.577 & 0.577 & -0.289 & -0.289 \\ -0.5 & 0.5 & 0 & 0 & 0.5 & -0.5 \\ 0.671 & -0.224 & 0 & 0 & 0.224 & -0.671 \end{pmatrix}$$

(As we reduced R so C is reduced to top rows only).

$$C := \text{submatrix}(C, 0, 2, 0, 5)$$

$$C = \begin{pmatrix} -0.408 & -0.408 & -0.408 & -0.408 & -0.408 & -0.408 \\ -0.289 & -0.289 & 0.577 & 0.577 & -0.289 & -0.289 \\ -0.5 & 0.5 & 0 & 0 & 0.5 & -0.5 \end{pmatrix}$$

$$R \cdot C = \begin{pmatrix} 0 & 0 & 1 & 1 & 0 & 0 \\ 0 & 1 & 0 & 0 & 1 & 0 \\ 1 & 1 & 1 & 1 & 1 & 1 \\ 1 & 0 & 0 & 0 & 0 & 1 \end{pmatrix}$$

Which is the same as the desired image.

In this case there are negative numbers in R and C which is undesirable for driving a passive matrix OLED display. By inspection it can be seen that a positive factorisation is possible:

$$R := \begin{pmatrix} 1 & 0 & 0 \\ 0 & 1 & 0 \\ 1 & 1 & 1 \\ 0 & 0 & 1 \end{pmatrix}$$

$$C := \begin{pmatrix} 0 & 0 & 1 & 1 & 0 & 0 \\ 0 & 1 & 0 & 0 & 1 & 0 \\ 1 & 0 & 0 & 0 & 0 & 1 \end{pmatrix}$$

$$R \cdot C = \begin{pmatrix} 0 & 0 & 1 & 1 & 0 & 0 \\ 0 & 1 & 0 & 0 & 1 & 0 \\ 1 & 1 & 1 & 1 & 1 & 1 \\ 1 & 0 & 0 & 0 & 0 & 1 \end{pmatrix}$$

Non-negative matrix factorization (NMF) provides a method for achieving this in the general case. In non-negative matrix factorization the image matrix I is factorised as:

$$I = W \cdot H \qquad \text{(Equation 3)}$$

Some examples of NMF techniques are described in the following references, all hereby incorporated by reference:

D. D. Lee, H. S. Seung. Algorithms for non-negative matrix factorization; P. Paatero, U. Tapper. Least squares formulation of robust non-negative factor analysis. Chemometr. Intell. Lab. 37 (1997), 23-35; P. Paatero. A weighted non-negative least squares algorithm for three-way 'PARAFAC' factor analysis. Chemometr. Intell. Lab. 38 (1997), 223-242; P. Paatero, P. K. Hopke, etc. Understanding and controlling rotations in factor analytic models. Chemometr. Intell. Lab. 60 (2002), 253-264; J. W. Demmel. Applied numerical linear algebra. Society for Industrial and Applied Mathematics, Philadelphia. 1997; S. Juntto, P. Paatero. Analysis of daily precipitation data by positive matrix factorization. Environmetrics, 5 (1994), 127-144; P. Paatero, U. Tapper. Positive matrix factorization: a non-negative factor model with optimal utilization of error estimates of data values. Environmetrics, 5 (1994), 111-126; C. L. Lawson, R. J. Hanson. Solving least squares problems. Prentice-Hall, Englewood Cliffs, NJ, 1974; Algorithms for Non-negative Matrix Factorization, Daniel D. Lee, H. Sebastian Seung, pages 556-562, Advances in Neural Information Processing Systems 13, Papers from Neural Information Processing Systems (NIPS) 2000, Denver, CO, USA. MIT Press 2001; and Existing and New Algorithms for Non-negative Matrix Factorization By Wenguo Liu & Jianliang Yi www.dcfl.gov/DCCl/rdwg/nmf.pdf; source code for the algorithms discussed therein can be found at http://www.cs.utexas.edu/users/liuwg/383CProject/CS_383C_Project.htm).

Figure 9A:
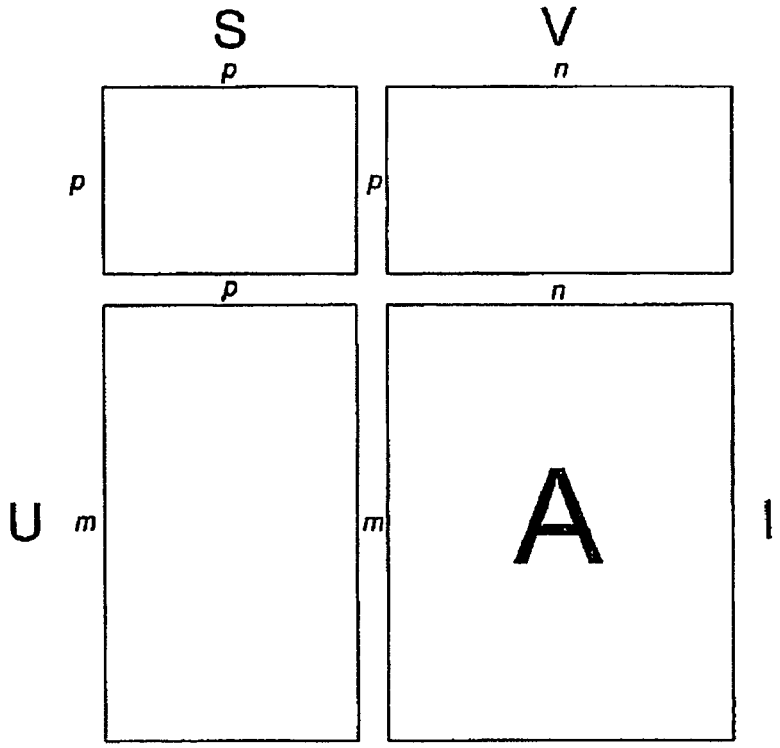
FIGS. 9*a* and 9*b* show, respectively, SVD and NMF factorisation of an image matrix.
Figure 9B:
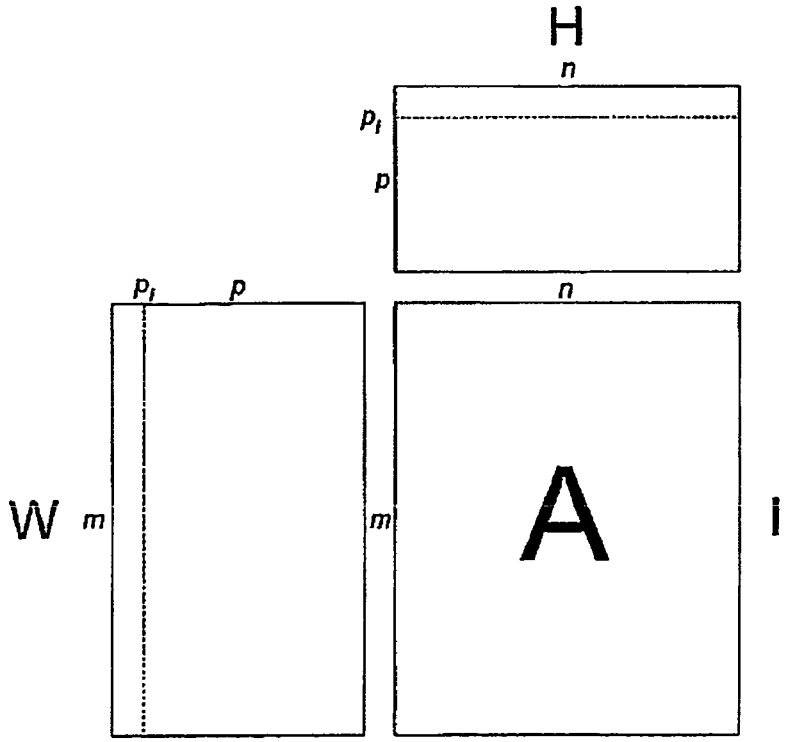

The NMF factorisation procedure is diagrammatically illustrated in FIG. 9*b*.

Once the basic above-described scheme has been implemented other techniques can be used for additional benefit. For example duplicate rows of pixels, which are not uncommon in Windows (trademark) type applications, can be written simultaneously to reduce the number of line periods, hence shortening the frame period and reducing the peak brightness required for the same integrated brightness. Once an SVD decomposition has been obtained the lower rows with only small (drive) values can be neglected as they are of decreasing significance to the quality of the final image. As described above the multi-line addressing technique described above is applied within a single displayed frame but it will be recognised that a luminescence profile of one or more rows may be built up over the time dimension additionally or alternatively to a spatial dimension. This may be facilitated by moving picture compression techniques in which between-frame time interpolation is employed.

Embodiments of the above MLA techniques are particularly useful in colour OLED displays, in which case the techniques are preferably employed for groups of red (R), green (G), and blue (B) sub-pixels as well as, optionally, between pixel rows. This is because images tend to contain blocks of similar colour, and because a correlation between R, G and B sub-pixel drives is often higher than between separate pixels. Thus in embodiments of the scheme rows for multi-line addressing are grouped into R, G, and B rows with three rows defining a complete pixel and an image being built up by selecting combinations of the R, G and B rows simultaneously. For example if a significant area of the image to be displayed is white the image can be built up by first selecting groups of R, G and B rows together while applying appropriate signals to the column drivers.

Application of the MLA scheme to a colour display has a further advantage. In a conventional colour OLED display a row of pixels has the pattern "RGBRGB . . . " so that when the row is enabled separate column drivers can simultaneously drive the R, G and B sub-pixels to provide a full colour illuminated pixel. However the three rows may have the configuration "RRRR . . . ", "GGGG . . . ", "BBBB . . . ", a single column addressing R, G and B sub-pixels. This configuration simplifies the application of an OLED display since a row of, say, red pixels may be (inkjet) printed in a single long trough (separated from adjacent troughs by the cathode separator) rather than separate "wells" being required to define regions for the three different coloured materials in each row. This enables the elimination of a fabrication step and also increases the pixel aperture ratio (that is the percentage of display area occupied by active pixel). Thus in a further aspect the invention provides a display of this type.

Figure 4A:
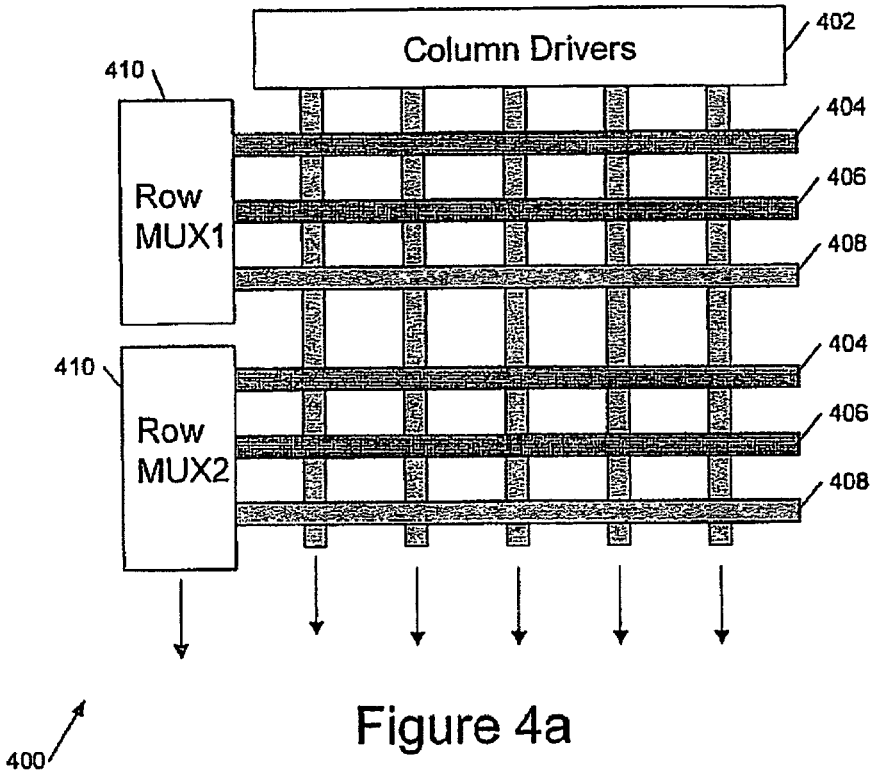
FIGS. 4*a* to 4*c*, show respectively, block diagrams of first and second examples of display driver hardware for implementing an MLA addressing scheme for a colour OLED display, and a timing diagram for such a scheme.

FIG. 4*a* shows a block diagram of an example display/driver hardware configuration 400 for such a scheme. As can be seen a single column driver 402 addresses rows of red 404, green 406 and blue 408 pixels. Permutations of red, green and blue rows are addressed using row selectors/multiplexers 410 or, alternatively, by means of a current sink controlling each row as described further later. It can be seen from FIG. 4*a* that this configuration allows red, green and blue sub-pixels to be printed in linear troughs (rather than wells) each sharing a common electrode. TMs reduces substrate patterning and printing complexity and increases aperture ratio (and hence indirectly lifetime through the reduced drive necessary). With the physical device layout of FIG. 4*a* a number or different MLA drive schemes may be implemented.

In a first example drive scheme an image is built up by addressing groups of rows in sequence as shown below:

1. White component: R, G, and B are selected and driven together
2. Red+Blue driven together
3. Blue+Green driven together
4. Red+Green driven together
5. Red only
6. Blue only
7. Green only Only the necessary colour steps are carried out to build up the image using the minimum number of colour combinations. The combinations may be optimised to increase lifetime and/or reduce power consumption, depending on the requirement of the application.

In an alternative colour MLA scheme, the driving of the RGB rows is split into three line scan periods, with each line period driving one primary. The primaries are combinations of R G and B chosen to form a colour gamut which encloses all the desired colours along a line or row of the display:

In one method the primaries are R+aG=aB, G+bR+bB, B+cR+cG where 0>=a,b,c>=1 and a, b and c are chosen to be the largest possible values (a+b+c=maximum) while still enclosing all desired colours within their colour gamut.

In another method a, b and c are chosen in a scheme to best improve the overall performance of the display. For example, if blue lifetime is a limiting factor, a and b may be maximised at the expense of c; if red power consumption is a problem, b and c can be maximised. This is because the total emitted brightness should equal a fixed value. Consider an example where D=C=O. In this case the red brightness must be fully achieved in the first scan period. However if b,c>0 then the red brightness is built up more gradually over multiple scan periods, thus reducing the peak brightness and increasing the red subpixel lifetime and efficiency.

In another variation the length of the individual scan periods can be adjusted to optimise lifetime or power consumptions (for example to provide increased scan time).

In a further variation the primaries may be chosen arbitrarily, but to define the minimum possible colour gamut which still encloses all colours on a line of the display. For example in an extreme case, if there were only shades of greens on a reproducible colour gamut.

Figure 4B:
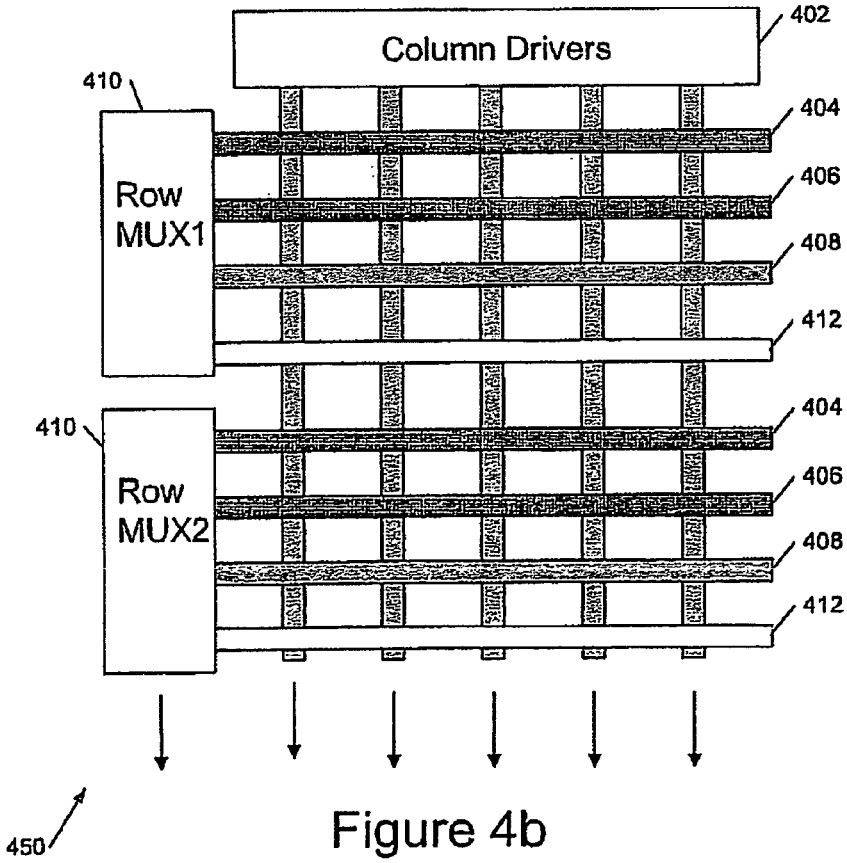

FIG. 4*b* shows a second example of display driver hardware 450 in which like elements to those in FIG. 4*a* are shown by like reference numerals. In FIG. 4*b* the display includes additional rows of white (W) pixels 412 which are also used to build up a colour image when driven in combination with three primaries.

The inclusion of white sub-pixels broadly speaking reduces the demands on the blue pixels thus increasing display lifetime; alternatively, depending on the drive scheme, power consumption for display of given colour may be reduced. Colours other than white, for example magenta, cyan, and/or yellow emitting sub-pixels may be included, for example to increase the colour gamut. The different coloured sub-pixels need not have the same area.

As illustrated in FIG. 4*b* each row comprises sub-pixels of a single colour, as described with reference to FIG. 4*a*, but it will be appreciated that a conventional pixel lavout may also be employed with successive R, G. B and W pixels along each row. In this case the columns will be driven by four separate column drivers, one for each of the four colours.

It will be appreciated that the above described multi-line addressing schemes may be employed in connection with the display/driver arrangement of FIG. 4*b*, with combinations of R, G, B and W rows being addressed in different permutations and/or with different drive ratios, either using row multiplexers (as illustrated) or a current sirik for each line. As described above an image is built up by successively driving different combinations of rows.

As outlined above and described in more detail below, some preferred drive techniques employ a variable current drive to the OLED display pixels. However a simpler drive scheme, which has no need for row current mirrors, may be implemented using one or more row selectors/multiplexers to select rows of the display singularly and in combination in accordance with the first example colour display drive scheme given above.

Figure 4C:
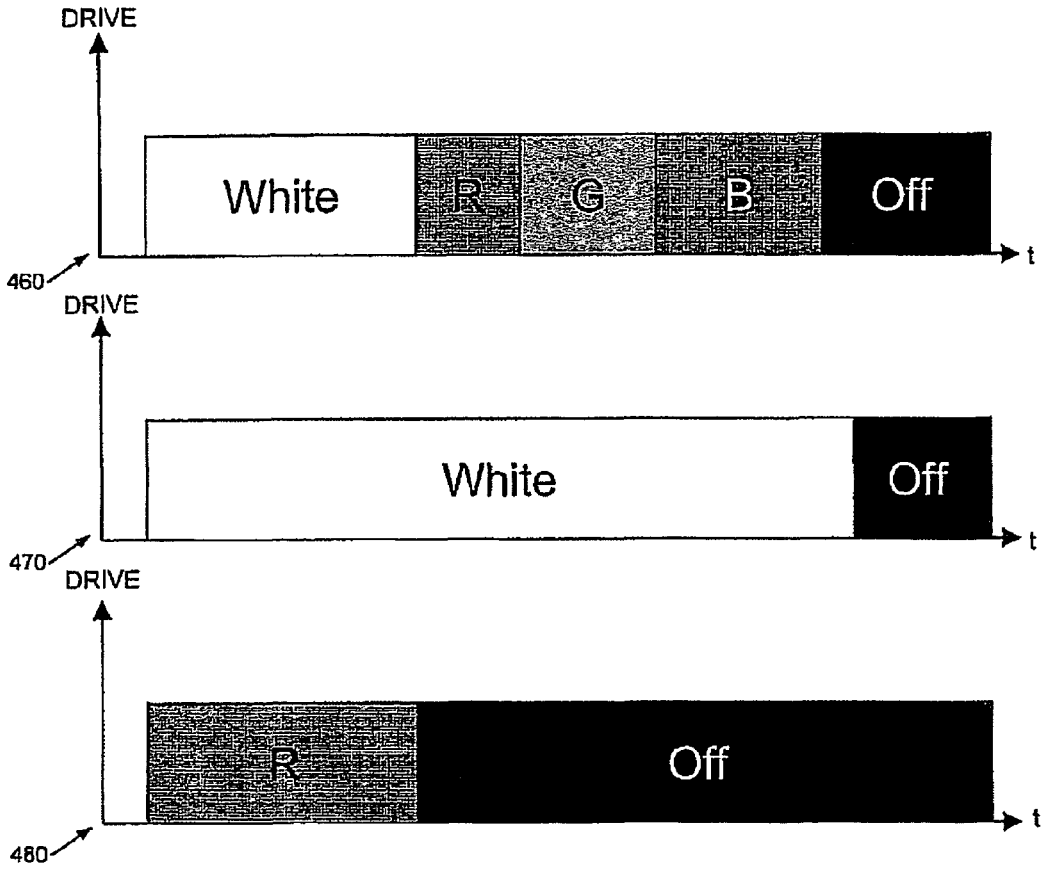

FIG. 4*c* illustrates the timing of row selection in such a scheme. In a first period 460 white, red, green and blue rows are selected and driven together; in a second period 470 white only is driven, and in a third period 4SO red only is driven, all according to a pulse-width modulation drive timing.

Figure 5A:
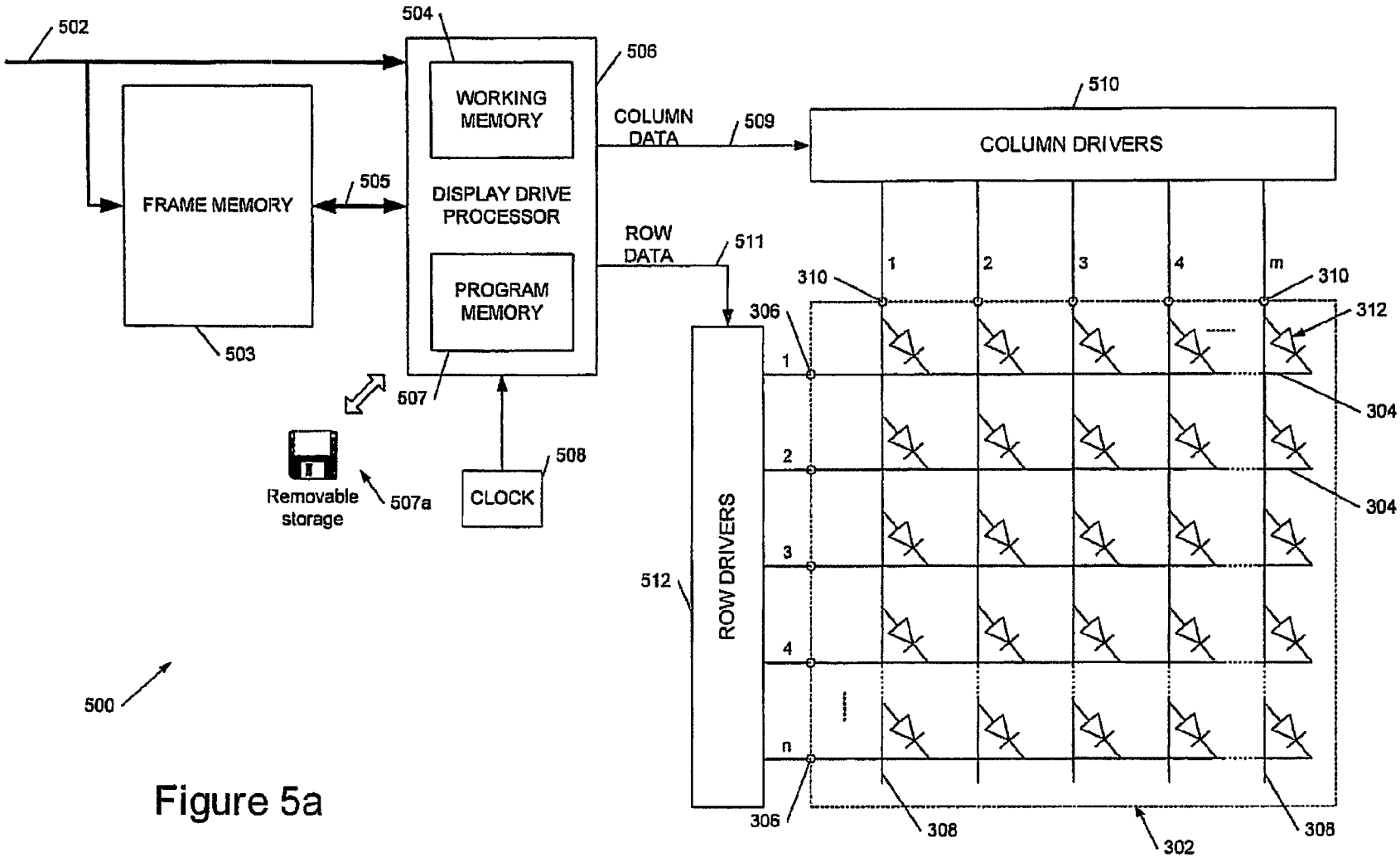
FIGS. 5*a* to 5*g* show, respectively, a display driver embodying an aspect of the present invention; column and row drivers, example digital-to-analogue current converters for the display driver of FIG. 5*a*, a programmable current mirror embodying an aspect of the present invention, a second programmable current mirror embodying an aspect of the present invention, and block diagrams of current mirrors according to the prior art.

Referring next to FIG. 5*a*, this shows a schematic diagram of an embodiment of a passive matrix OLED driver 500 which implements an MLA addressing scheme as described above.

Figure 3:
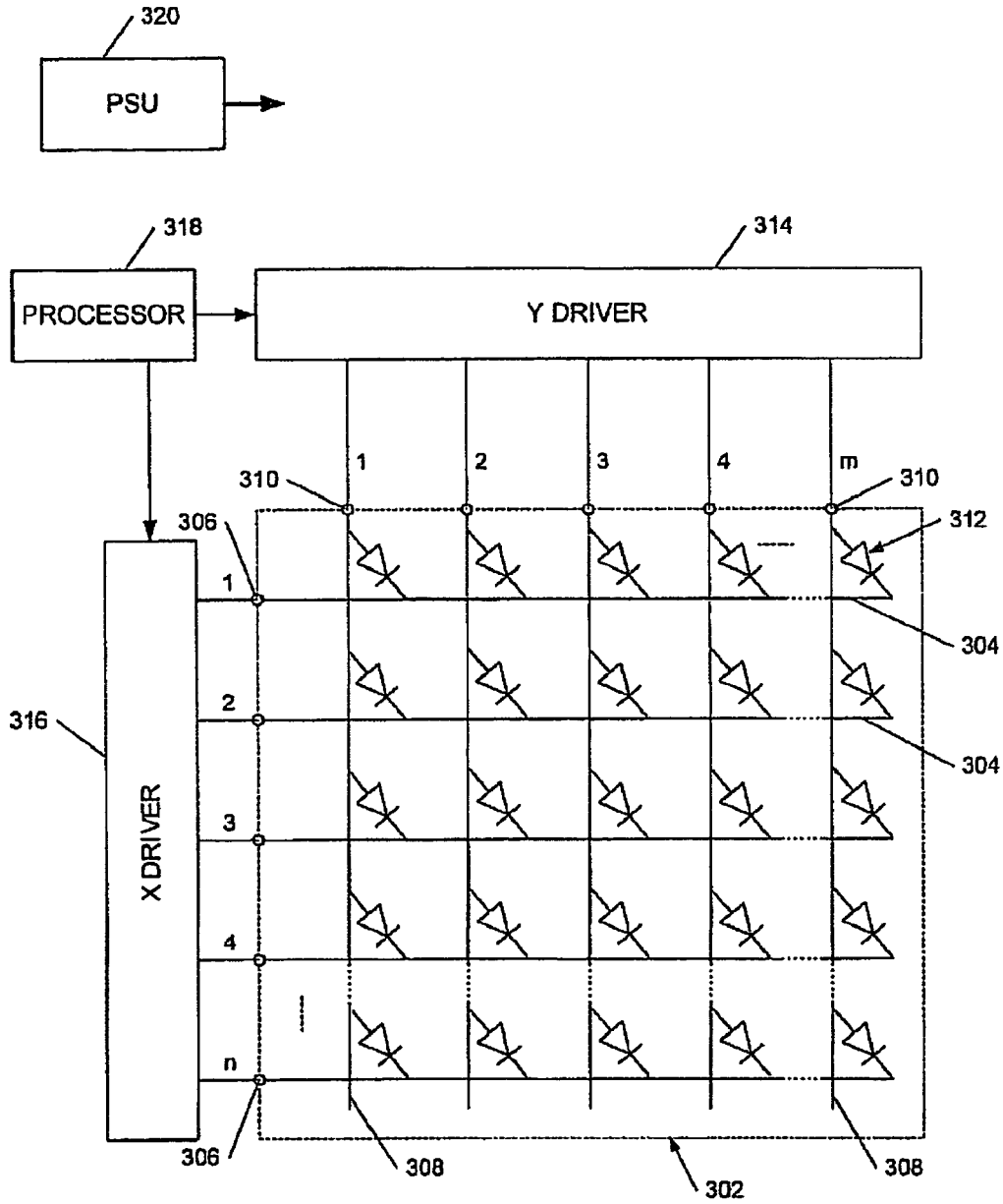
FIG. 3 shows a block diagram of a known passive matrix OLED display driver.
Figure 5B:
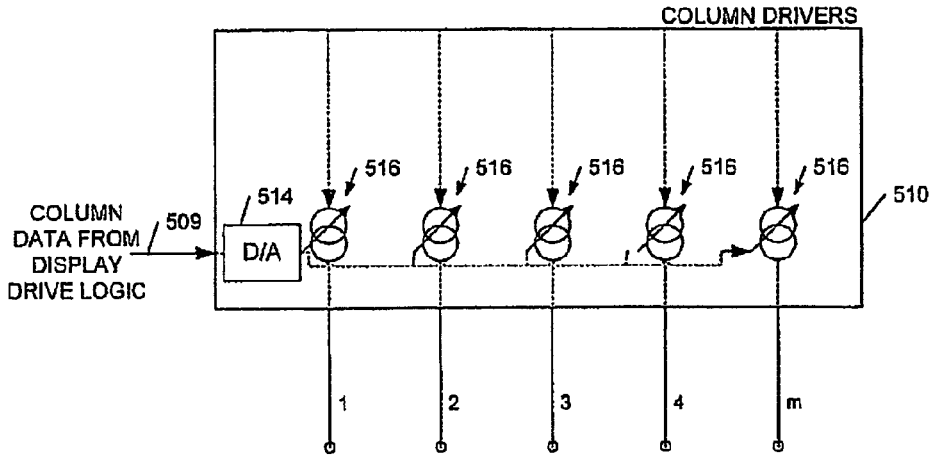
Figure 5B:
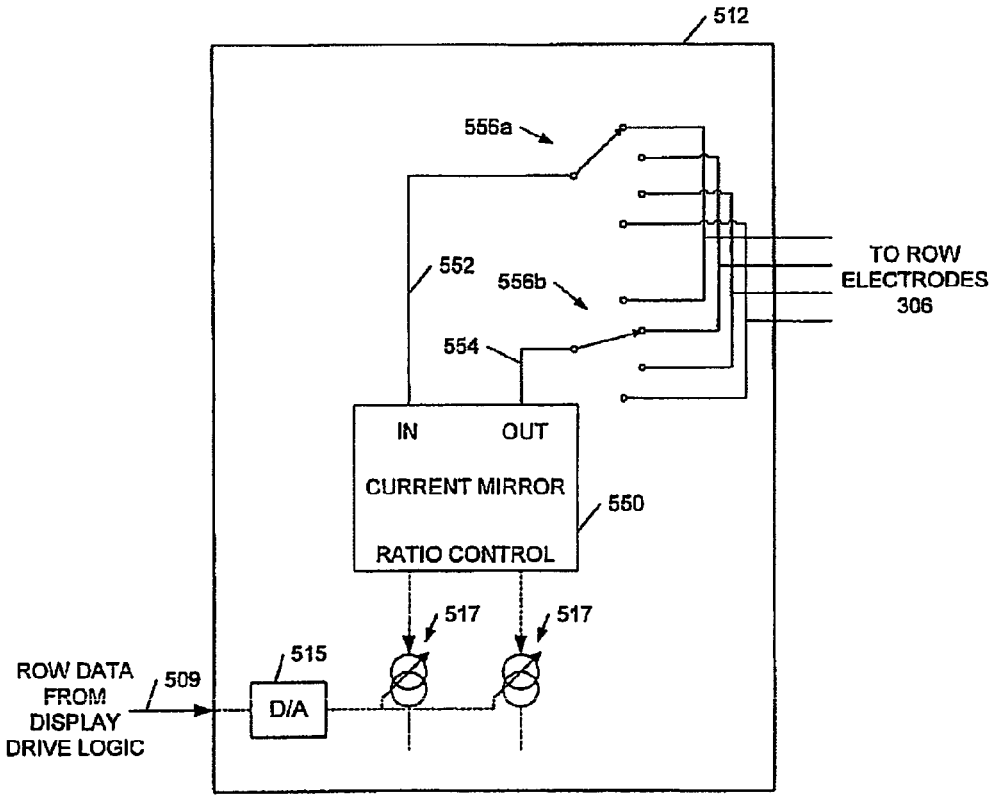

In FIG. 5*a* a passive matrix OLED display similar to that described with reference to FIG. 3 has row electrodes 306 driven by row driver circuits 512 and column electrodes 310 driven by column drives 510. Details of these row and column drivers are shown in FIG. 5*b*. Column drivers 510 have a column data input 509 for setting the current drive to one or more of the column electrodes; similarly row drivers 512 have a row data input 511 for setting the current derive ratio to two or more of the rows. Preferably inputs 509 and 511 are digital inputs for ease of interfacing; preferably column data input 509 sets the current drives for all the m columns of display 302.

Data for display is provided on a data and control bus 502, which may be either serial or parallel. Bus 502 provides an input to a frame store memory 503 which stores luminance data for each pixel of the display or, in a colour display, luminance information for each sub-pixel (which may be encoded as separate RGB colour signals or as luminance and chrominance signals or in some other way). The data stored in frame memory 503 determines a desired apparent brightness for each pixel (or sub-pixel) for the display, and this information may be read out by means of a second, read bus 505 by a display drive processor 506 (in embodiments bus 505 may be omitted and bus 502 used instead).

Display drive processor 506 may be implemented entirely in hardware, or in software using, say, a digital signal processing core, or in a combination of the two, for example, employing dedicated hardware to accelerate matrix operations. Generally, however, display drive processor 506 will be at least partially implemented by means of stored program code or micro code stored in a program memory 507, operating under control of a clock 508 and in conjunction with working memory 504. Code in program memory 507 may be provided on a data carrier or removable storage 507*a*.

The code in program memory 507 is configured to implement one or more of the above described multi-line addressing methods using conventional programming techniques. In some embodiments these methods may be implemented using a standard digital signal processor and code running in any conventional programming language. In such an instance a conventional library of DSP routines may be employed, for example, to implement singular value decomposition, or dedicated code may be written for this purpose, or other embodiments not employing SVD may be implemented such as the techniques described above with respect to driving colour displays.

Referring now to FIG. 5*b*, this shows details of the column 510 and row 512 drivers of FIG. 5*a*. The column driver circuitry 510 includes a plurality of controllable reference current sources 516, one for each column line, each under control of respective digital-to-analogue converter 514. Details of example implementations of these are shown in FIG. 5*c* where it can be seen that a controllable current source 516 comprises a pair of transistors 522, 524 connected to a power line 518 in a current mirror configuration.

Since, in this example, the column drivers comprise current sources these are PNP bipolar transistors connected to a positive supply line; to provide a current sink NPN transistors connected to ground are employed; in other arrangements MOS transistors are used. The digital-to-analogue converters 514 each comprise a plurality (in this instance three) of FET switches 528, 530, 532 each connected to a respective power supply 534, 536, 538. The gate connections 529, 531, 533 provide a digital input switching the respective power supply to a corresponding current set resistor 540, 542, 544, each resistor being connected to a current input 526 of a current mirror 516. The power supplies have voltages scaled in powers of two, that is each twice that of the next lowest power supply less a $V_{gs}$ drop so that a digital value on the FET gate connections is converted into a corresponding current on a line 526; alternatively the power supplies may have the same voltage and the resistors 540, 542, 544 may be scaled. FIG. 5*c* also shows an alternative D/A controlled current source/sink 546; in this arrangement where multiple transistors are shown a single appropriately-sized larger transistor may be employed instead.

Figure 5C:
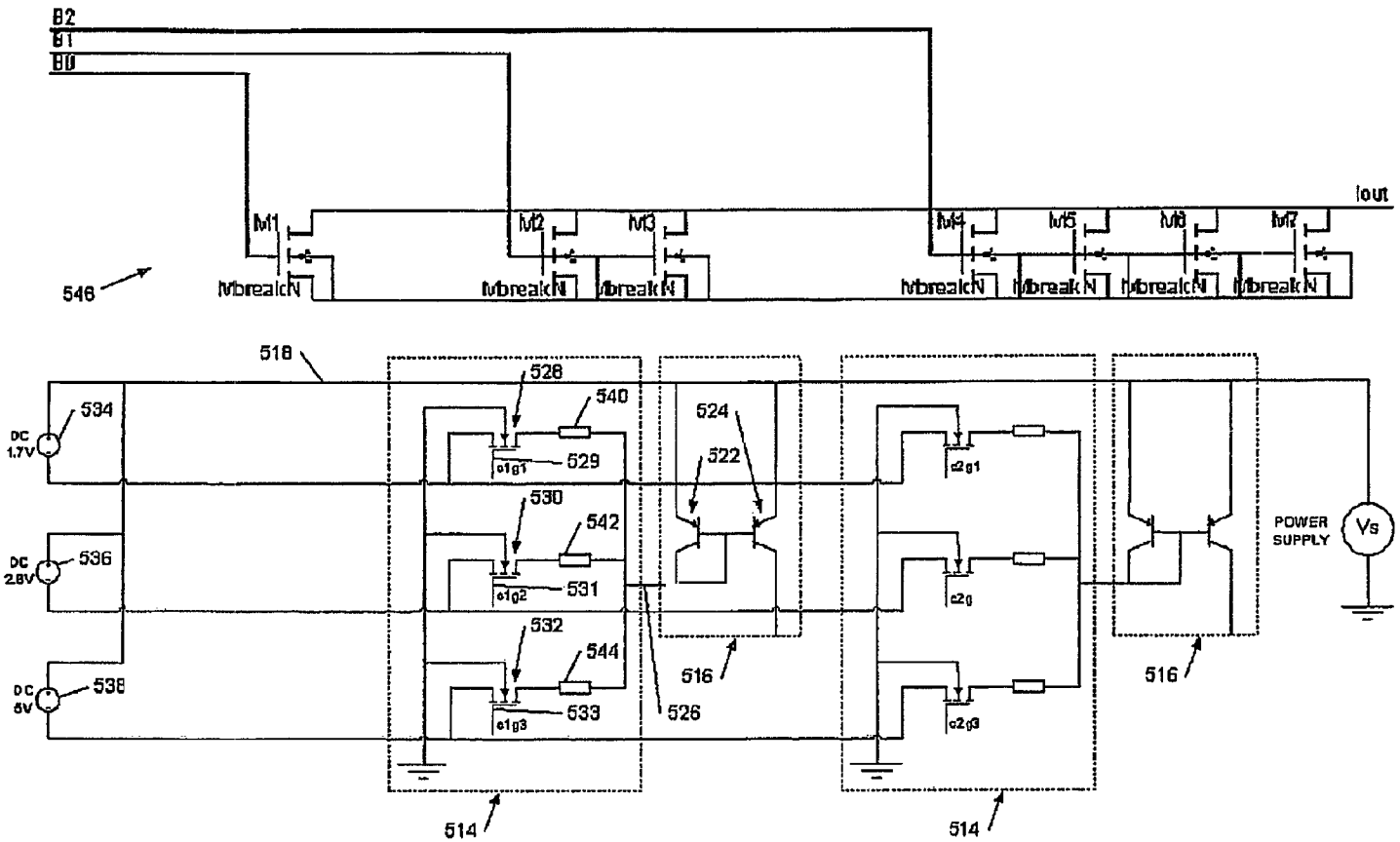

The row drivers 512 also incorporate two (or more) digitally controllable current sources 515, 517, and these may be implemented using similar arrangements to those shown in FIG. 5*c*, employing current sink rather than current source mirrors. In mis way controllable current sinks 517 may be programmed to sink currents in a desired ratio (or ratios) corresponding to a ratio (or ratios) of row drive levels. Controllable current sinks 517 are thus coupled to a ratio control current mirror 550 which has an input 552 for receiving a first, referenced current and one or more outputs 554 for receiving (sinking) one or more (negative) output currents, the ratio of an output current to the input current being determined by a ratio of control inputs defined by controllable current generators 517 in accordance with row data on line 509. Two row electrode multiplexers 556*a, b* are provided to allow selection of one row electrode to provide a reference current and another row electrode to provide an "output" current; optionally further selectors/multiplexers 556*b* and mirror outputs from 550 may be provided. As illustrated row driver 512 allows the selection of two rows for concurrent driving from a block of four row electrodes but in practice alternative selection arrangements may be employed—for example in one embodiment twelve rows (one reference and eleven mirrors) are selected from 64 row electrodes by twelve 64 way multiplexers; in another arrangement the 64 rows may be divided into several blocks each having an associated row driver capable of selecting a plurality of rows for simultaneous driving.

Figure 5D:
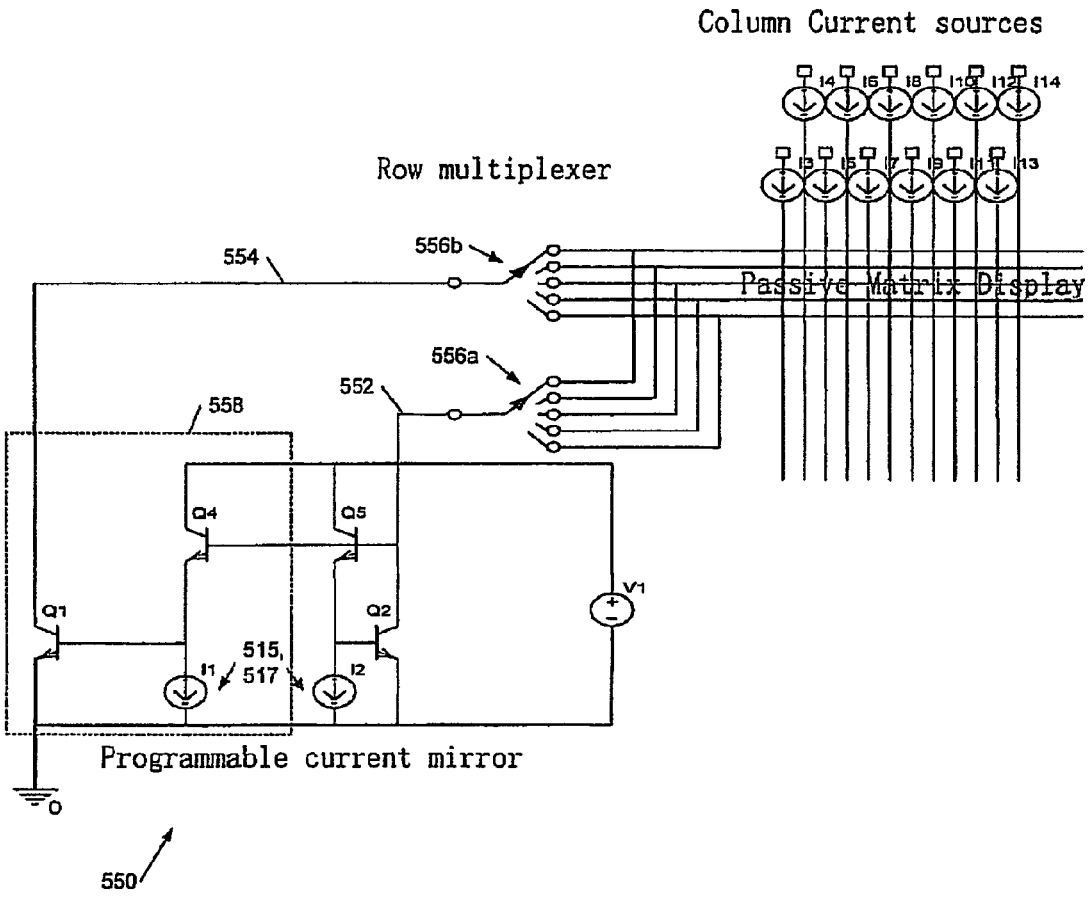

FIG. 5*d* shows details of an implementation of the programmable ratio control current mirror 550 of FIG. 5*b*. In this example implementation a bipolar current mirror with a so-called beta helper (Q5) is employed, but the skilled person will recognise that many other types of current mirror circuit may also be used. In the circuit of FIG. 5*d* V1 is a power supply of typically around 3V and I1 and I2 define the ratio of currents in the collectors of Q1 and Q2. The currents in the two lines 552, 554 are in the ratio I1 to I2 and thus a given total column current is divided between the two selected rows in this ratio. The skilled person will appreciate that this circuit can be extended to an arbitrary number of mirrored rows by providing a repeated implementation of the circuitry within dashed line 558.

Figure 5E:
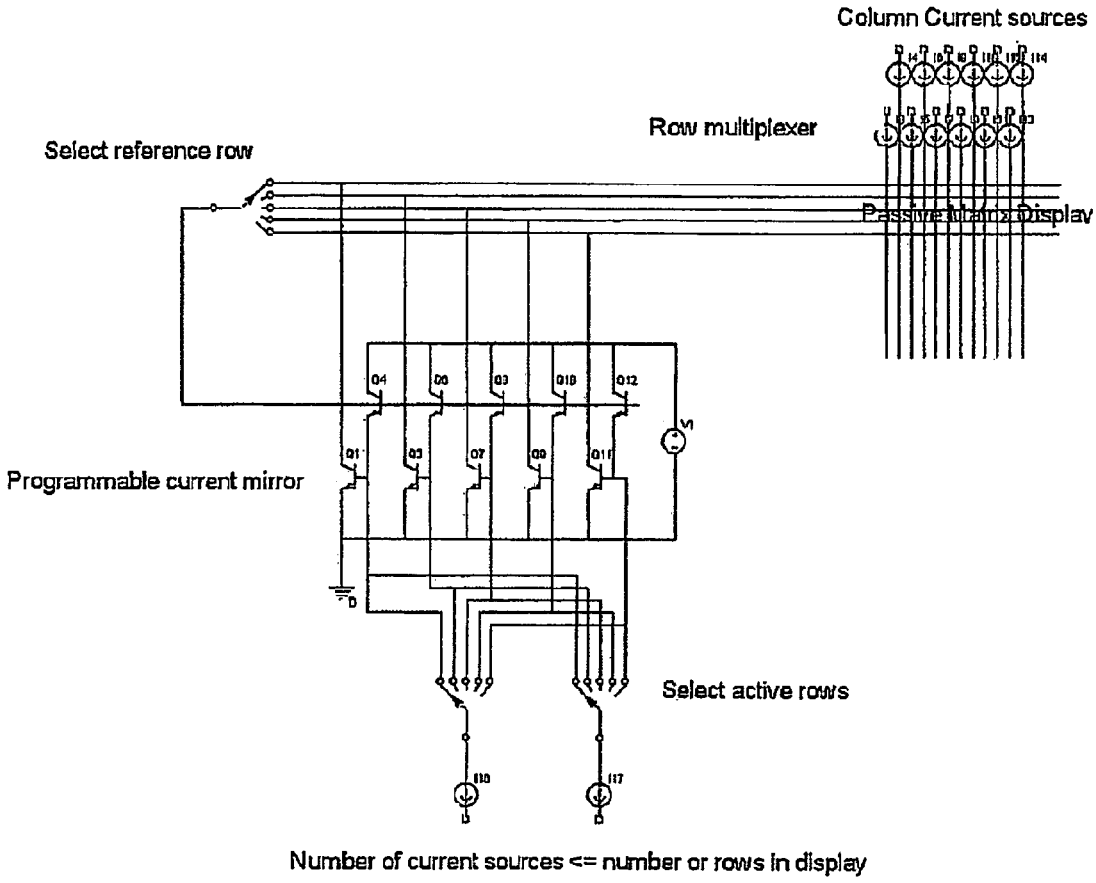

FIG. 5*e* illustrates an alternative embodiment of a programmable current mirror for the row driver 512 of FIG. 5*b*. In this alternative embodiment each row is provided with circuitry corresponding to that within dashed line 558 of FIG. 5*d*, that is with a current mirror output stage, and then one or more row selectors connects selected ones of these current mirror output stages to one or more respective programmable reference current supplies (source or sink). Another selector selects a row to be used as a reference input to the current mirror.

In embodiments of the above-described row drivers row selection need not be employed since a separate current mirror output may be provided for each row either of the complete display or for each row of a block of rows of the display. Where row selection is employed rows may be grouped in blocks—for example where a current mirror with three outputs is employed with selective connection to, say a group of 12 rows, sets of three successive rows may be selected in turn to provide three-line MLA for the 12 rows. Alternatively rows may be grouped using a prior knowledge relating to the line image to be displayed, for example where it is known that a particular sub-section of the image would benefit from MLA because of the nature of the displayed data (significant correlation between rows).

Figure 5F:
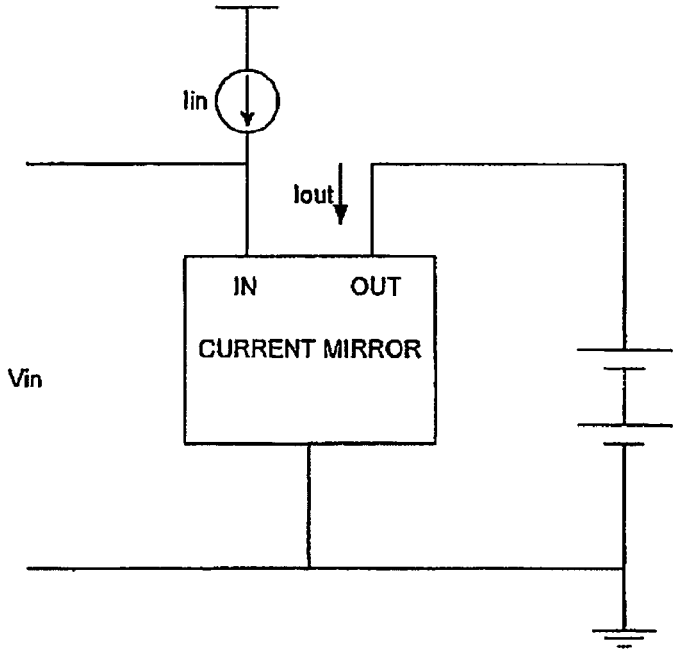
Figure 5G:
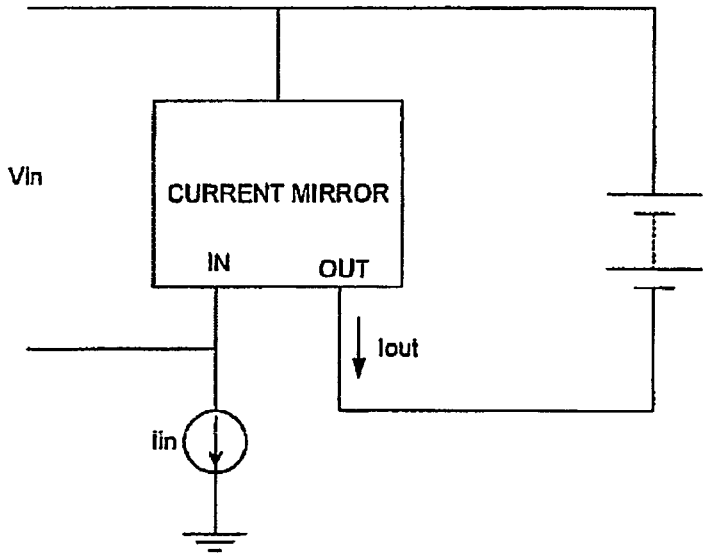

FIGS. 5*f* and 5*g* illustrate current mirror configurations according to the prior art with, respectively, a ground reference and a positive supply reference, showing the sense of the input and output currents. It can be seen that these currents are both in the same sense but maybe either positive or negative.

Figure 6:
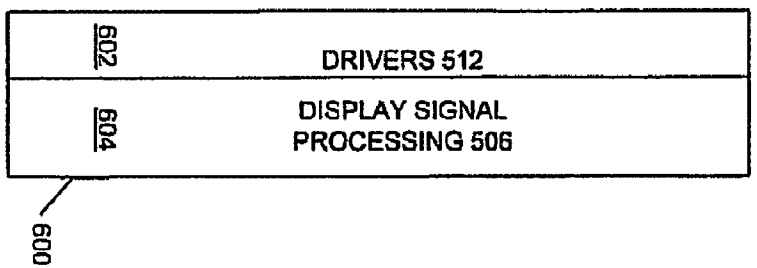
FIG. 6 shows, a layout of an integrated circuit die incorporating multi-line addressing display signal processing circuitry and driver circuitry.

FIG. 6 shows a layout of an integrated circuit die 600 combining the row drivers 512 and display drive processor 506 of FIG. 5*a*. The die has the shape of an elongated rectangle, of example dimensions 20 mm×1 mm, with a first region 602 for a long line of driver circuitry comprising repeated implementations of substantially the same set of devices, and an adjacent region 604 used to implement the MLA display processing circuitry. Region 604 would otherwise be unused space since there is a minimum physical width to which a chip can be diced.

The above described MLA display drivers employ a variable current drive to control OLED luminance but the skilled person will recognise that other means of varying the drive to an OLED pixel, in particular PWM, may additionally or alternatively employed.

Figure 7:
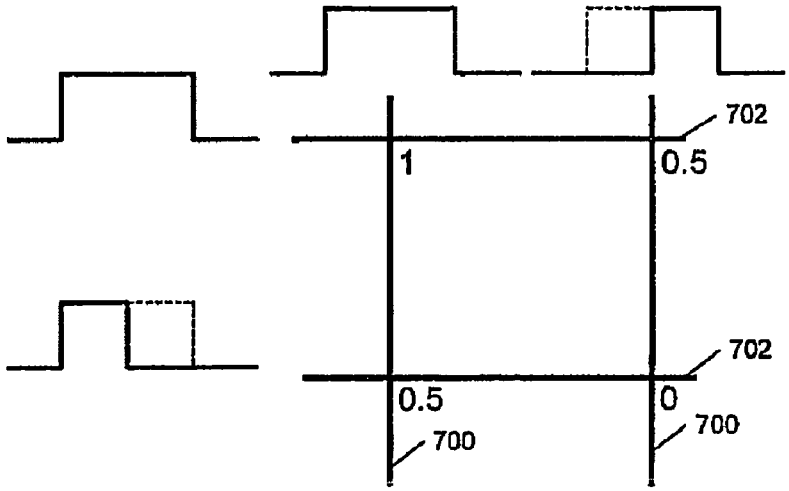
FIG. 7 shows a schematic illustration of a pulse width modulation MLA drive scheme.

FIG. 7 shows a schematic illustration of a pulse width modulation drive scheme for multi-line addressing. In FIG. 7 the column electrodes 700 are provided with a pulse width modulated drive at the same time as two or more row electrodes 702 to achieve the desired luminance patterns. In the example of FIG. 7 the zero value shown could be smoothly varied up to 0.5 by gradually shifting the second row pulse to a later time; in general a variable drive to a pixel may be applied by controlling a degree of overlap of row and column pulses.

Some preferred MLA methods employing matrix factorisation will now be described in more detail.

Figure 8A:
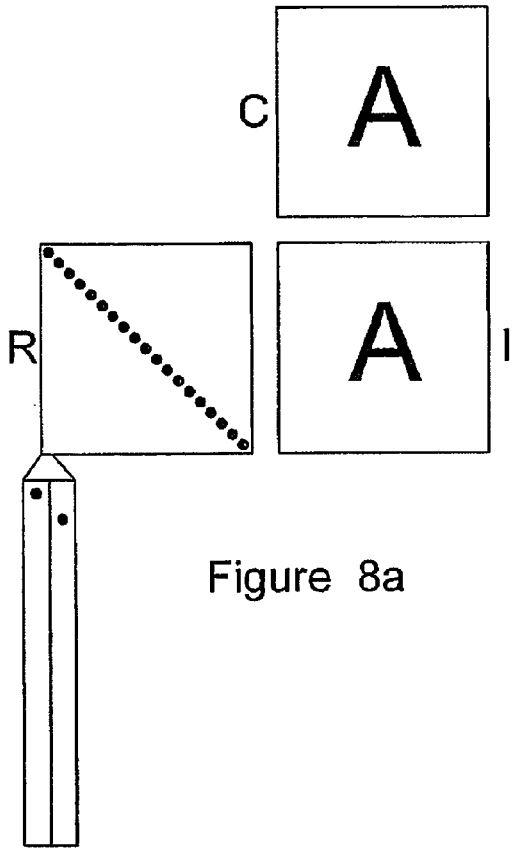
FIGS. 8*a* to 8*d* show row, column and image matrices for a conventional drive scheme and for a multiline addressing drive scheme respectively, and corresponding brightness curves for a typical pixel over a frame period.
Figure 8B:
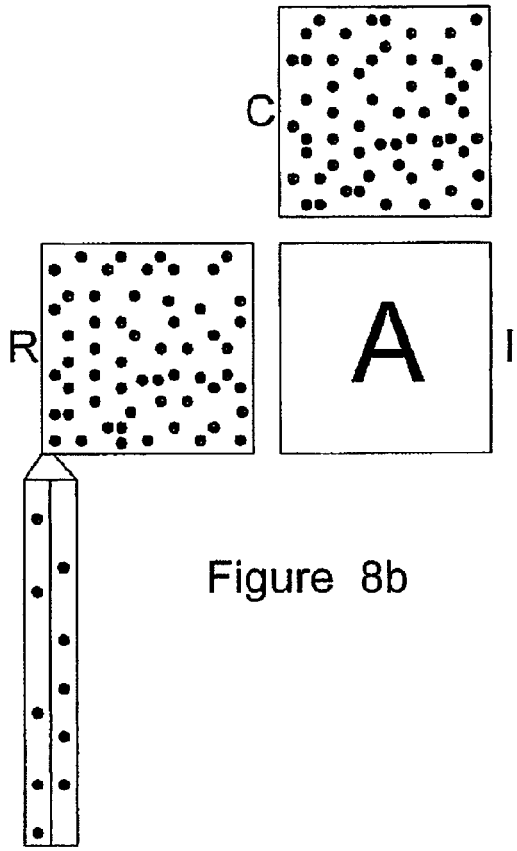
Figure 8C:
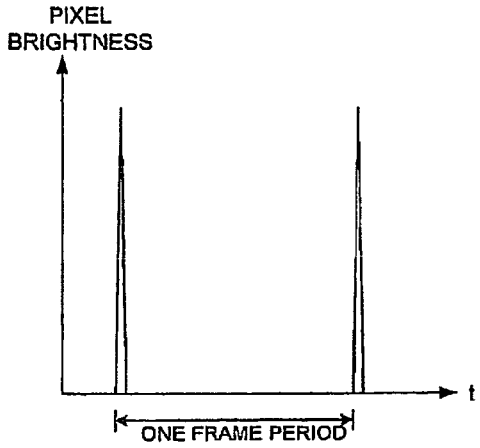
Figure 8D:
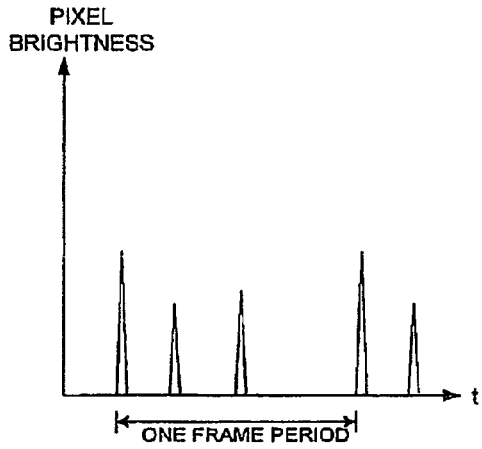

Referring to FIG. 8*a*, mis shows row R, column C and image I matrices for a conventional drive scheme in which one row is driven at a time. FIG. 8*b* shows row, column and image matrices for a multiline addressing scheme. FIGS. 8*c* and 8*d* illustrate, for atypical pixel of the displayed image, the brightness of the pixel, or equivalently the drive to the pixel, over a frame period, showing the reduction in peak pixel drive which is achieved through multiline addressing.

FIG. 9*a* illustrates, diagrammatically, singular value composition (SVD) of an image matrix I according to Equation 2 below:

$$\underset{m\times n}{I} = \underset{m\times p}{U} \times \underset{p\times p}{S} \times \underset{p\times n}{V} \qquad \text{Equation 2}$$

The display can be driven by any combination of U, S and V, for example driving rows US and columns with V or driving rows with UvS and column with Vs.V other related techniques such as QR decomposition and LU decomposition can also be employed. Suitable numerical techniques are described in, for example, "Numerical Recipes in C: The Art of Scientific Computing", Cambridge University Press 1992; many libraries of program code modules also include suitable routines.

Figure 10:
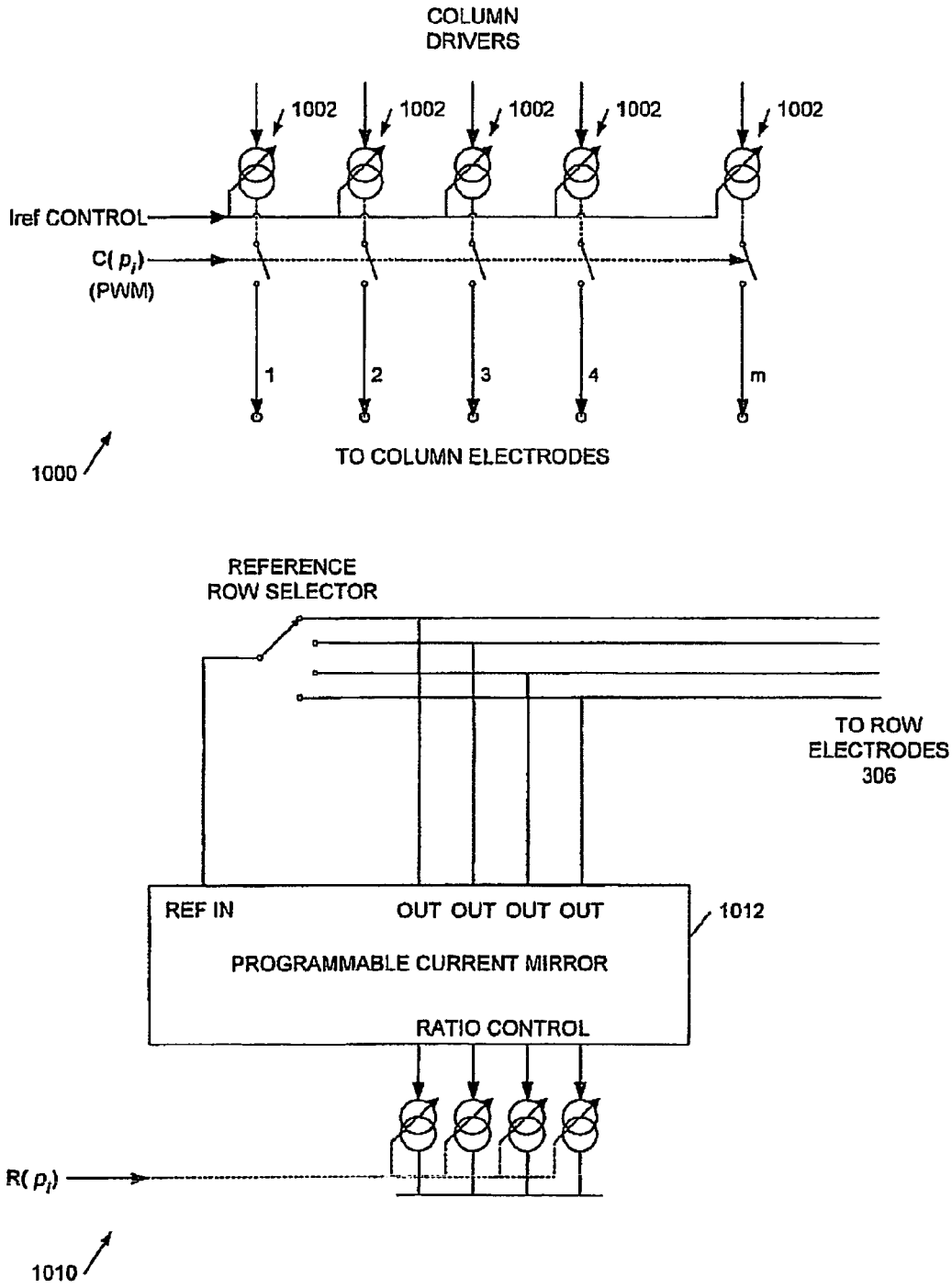
FIG. 10 shows example column and row drive arrangements for driving a display using the matrices of FIG. 9.

FIG. 10 illustrates row and column drivers similar to those described with reference to FIGS. 5*b* to 5*e* and suitable for driving a display with a factorised image matrix. The column drivers 1000 comprise a set of adjustable substantially constant current sources 1002 which are ganged together and provided with a variable reference current $I_{ref}$ for setting the current into each of the column electrodes. This reference current is pulse width modulated by a different value for each column derived from a row of a factor matrix such as row $p_i$ of matrix H of FIG. 9*b*. The row drive 1010 comprises a programmable current mirror 1012 similar to that shown in FIG. 5*e* but preferably with one output for each row of the display or for each row of a block of simultaneously driven rows. The row drive signals are derived from a column of a factor matrix such as column $p_i$ of matrix W of FIG. 9*b*.

Figure 11:
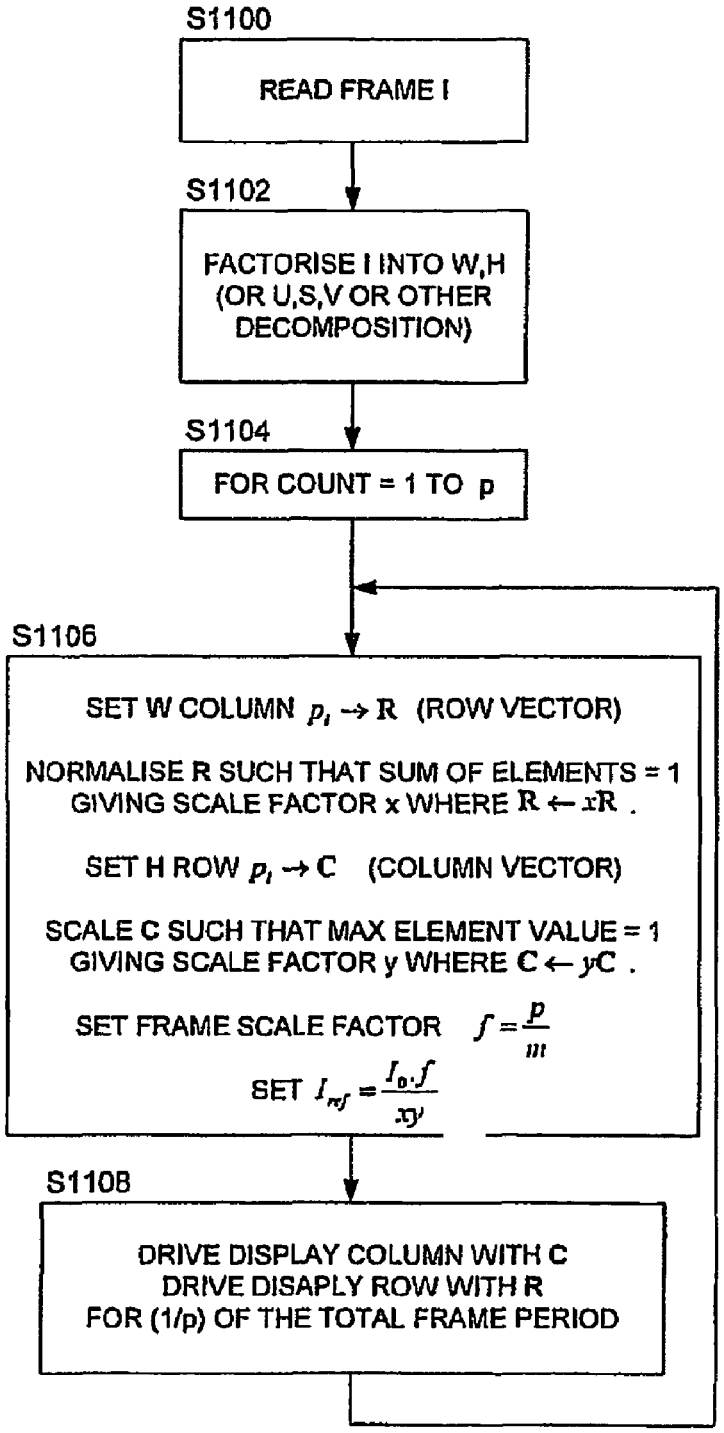
FIG. 11 shows a flow diagram for a method of driving a display using image matrix factorisation.

FIG. 11 shows a flow diagram of an example procedure for displaying an image using matrix factorisation such as NMF, and which may be implemented in program code stored in program memory 507 of display drive processor 506 of FIG. 5*a*.

In FIG. 11 the procedure first reads the frame image matrix I (step S1100), and then factorises this image matrix into factor matrices W and H using NMF, or into other factor matrices, for example U, S and V when employing SVD (step S1102). This factorisation may be computed during display of an earlier frame. The procedure then drives the display with p subframes at step 1104. Step 1106 shows the subframe drive procedure.

The subframe procedure sets W-column $p_i \rightarrow R$ to form a row vector R. This is automatically normalised to unity by the row driver arrangement of FIG. 10 and a scale factor x, $R \leftarrow xR$ is therefore derived by normalising R such that the sum of elements is unity. Similarly with H, row $p_i \rightarrow C$ to form a column vector C. This is scaled such that the maximum element value is 1, giving a scale factor y, $C \leftarrow yC$ . The a frame scale factor $$f = \frac{p}{m}$$

is determined and the reference current set by $$I_{ref} = \frac{I_0 \cdot f}{xy}$$

where Io corresponds to the current required for full brightness in a conventionally scanned linae at a time system, the x and y factors compensating for scaling effects introduced by the driving arrangement (with other driving arrangements one or both of these may be omitted).

Following this, at step S1 108, the display drivers shown in FIG. 10 drive the columns of the display with C and rows of the display with R for 1/p of the total frame period. This is repeated for each subframe and the subframe data for the next frame is then output.

Figure 12:
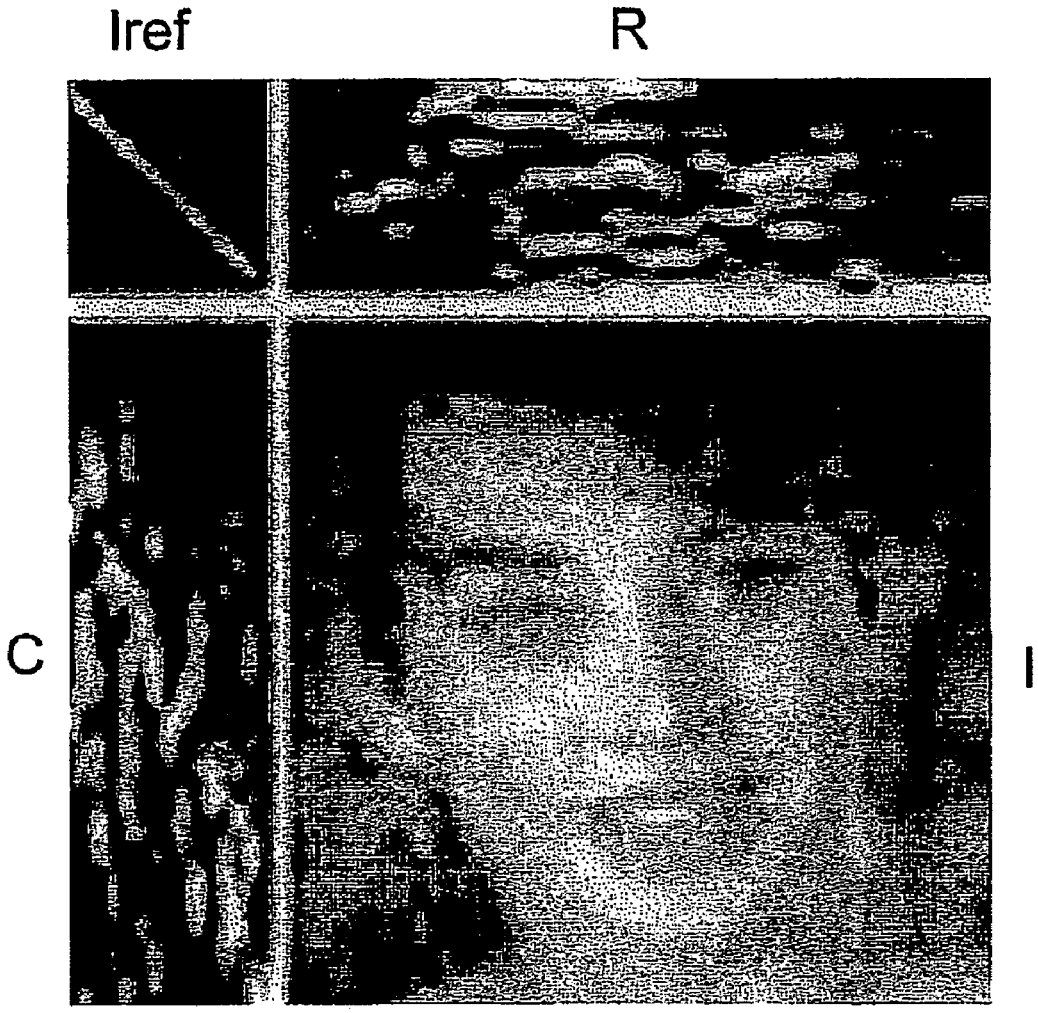
FIG. 12 shows an example of a displayed image obtained using image matrix factorisation.

FIG. 12 shows an example of an image constructed in accordance with an embodiment of the above described method; the format corresponds to that of FIG. 9*b*. The image in FIG. 12 is defined by a 50 ×50 image matrix which, in this example, is displayed using 15 subframes (p=15). The number of subframes can be determined in advance or varied according to the nature of the image displayed.

The image manipulation calculations to be performed are not dissimilar in their general character to operations performed by consumer electronic imaging devices such as digital cameras and embodiments of the method may be conveniently implemented in such devices.

In other embodiments the method can be implemented on a dedicated integrated circuit, or by means of a gate array, or in the software on a digital signal processor, or in some combination of these.

The above described techniques are applicable to both organic and inorganic LED-based displays. The TMA schemes described have pulsed width modulated column drive (time control) on one axis and current division ratio (current control) on the other axis. For inorganic LEDs voltage is proportional to logarithm current (so a product of voltages is given by a sum of the log currents), however for OLEDs there is a quadratic current-voltage dependence. In consequence when the above described techniques are used to drive OLEDs it is important that PWM is employed. This is because even with current control there is a characteristic which defines the voltage across a pixel required for a given current and with only current control the correct voltage for each pixel of a subframe cannot necessarily be applied. The TMA schemes described nonetheless work correctly with OLEDs because rows are driven to achieve the desired current and columns are driven with a PWM time, in effect decoupling the column and row drives, and hence decoupling the voltage and current variables by providing two separate control variables.

Referring again to the NMF factorisation of an image matrix, some particularly preferred fast NMF matrix factorisation techniques are described in the Applicant's co-pending UK patent application no. 0428191.1, filed 23 Dec. 2004, the contents of which are hereby incorporated by reference in their entirety.

Some further optimizations are as follows:

Because current is shared between rows, if the current in one row increases the current in the rest reduces, so preferably (although this is not essential) the reference current and subframe time are scaled to compensate. For example, the subframe times can be adjusted with the aim of having the peak pixel brightness in each subframe equal (also reducing worst-case/peak-brightness aging). In practice this is limited by the shortest selectable sub-frame time and also by the maximum column drive current, but since the adjustment is only a second order optimisation this is not a problem.

Later sub-frames apply progressively smaller corrections and hence they tend to be overall dimmer whereas the earlier sub-frames tend to be brighter. With PWM drive, rather than always have the start of the PWM cycle an "on" portion of the cycle, the peak current can be reduced by randomly dithering the start of the PWM cycle. In a straightforward practical implementation a similar benefit can be achieved with Jess complexity by, where the off-time is greater than 50%, starting the "on" portion timing for half the PWM cycles at the end of the available period. This is potentially able to reduce the peak row drive current by 50%.

With rows comprising red (R), green (G) and blue (B) (sub-)pixels (i.e. an RGB, RGB, RGB row pattern), because each (sub-)pixel has different characteristics a given voltage applied to a row may not achieve the exact desired drive currents for each differently coloured OLED (sub-)pixel. It is therefore preferable to use an OLED display with separately drivable rows of red, green and blue (sub-)pixels (i.e. groups of three rows with respective RRRR . . . , GGGG . . . and BBBB . . . patterns). The advantages of such a configuration in relation to ease of manufacture have already been mentioned above.

Embodiments of the invention have been described with specific reference to OLED-based displays. However the techniques described herein are also applicable to other types of emissive display including, but not limited to, vacuum fluorescent displays (VFDs) and plasma display panels (PDPs) and other types of electroluminescent display such as thick and thin (TFEL) film electroluminescent displays, for example iFire (RTM) displays, large scale inorganic displays and passive matrix driven displays in general.

No doubt many other effective alternatives will occur to the skilled person. It will be understood that the invention is not limited to the described embodiments and encompasses modifications apparent to those skilled in the art lying within the spirit and scope of the claims appended hereto.

What is claimed is:

1. A method of driving an emissive display, the display comprising a plurality of pixels each addressable by a row electrode and a column electrode, the method comprising: driving a plurality of said column electrodes with a first set of column drive signals; and driving a first group of two or more of said row electrodes with a plurality of forward bias row drive signals, which is a first set of forward bias row drive signals to cause pixels in two or more rows of the display to emit light at the same time, at the same time as said column electrode driving with said column drive signals; then driving said plurality of column electrodes with a second set of column drive signals; and driving a second group of said two or more row electrodes with a second plurality of forward bias row drive signals, which is a set of forward bias row drive signals to cause a plurality of pixels in each of two or more rows of the display to emit light at the same time, at the same time as said column electrode driving with said second column drive signals, wherein said electrodes of said first group are selected based on correlation or expected correlation between rows of image data and said row electrodes of said second group are selected based on correlation or expected correlation between rows of image data, wherein said pixels are OLED pixels and selecting of said first and second column drive signals and said selecting of said row electrodes of said first and second groups is performed such that a desired luminescence of said OLED pixels driven by said row and column electrodes is obtained by a substantially linear sum of luminances determined by said first row and column drive signals and luminances determined by said second row and column drive signals and to thereby build up a luminescence profile of a said row over a plurality of row scan periods.

2. A method as claimed in claim 1, wherein said first and second column drive signals and said first and second row drive signals are selected such that a peak luminance of a said pixel driven by said row and column electrodes is less than said peak luminance would be if said row electrodes were driven separately.

3. A method as claimed in claim 1, further comprising omitting said driving with said second row and column drive signals for two or more rows of said pixels having substantially the same desired luminance.

4. A method as claimed in claim 1, wherein said two or more row electrodes drive adjacent rows of said pixels.

5. A method as claimed in claim 1, wherein said two or more row electrodes drive separated or alternate rows of said pixels.

6. A method as claimed in claim 1, further comprising omitting to drive said two or more row electrodes when said second row drive signals are substantially all less than a threshold drive value.

7. A method as claimed claim 1, wherein both said first and second row drive signals and said first and second column drive signals comprise pulse width modulated drive signals.

8. A method as claimed in claim 1, wherein said first and second row and column drive signals comprise current drive signals.

9. A method as claimed in claim 8 further comprising driving said first and second row electrodes using a controllable current divider to divide said first column current drive signals between said two or more rows in accordance with said first row drive signals and to divide said second column current drive signals between said two or more rows in accordance with said second row drive signals.

10. A method as claimed in claim 1, wherein each said pixel comprises at least two sub-pixels of at least two different colours, each subpixel being addressable by a said row and column electrode, and wherein said driving of said two or more row electrodes comprises driving row electrodes of said two or more subpixels of a common pixel.

11. A method as claimed in claim 1, wherein each said pixel comprises at least two sub-pixels of at least two different colours, each subpixel being addressable by a said row and column electrode, and wherein said driving of said two or more row electrodes comprises driving row electrodes of subpixels of the same colour.

12. A method as claimed in claim 1, said further comprising selecting said two or more row electrodes from row electrodes in a group of three or more adjacent rows of electrodes.

13. A method as claimed in claim 1, wherein said row electrode driving comprises driving three or more of said row electrodes with said first and second sets of row drive signals, the method further comprising driving said plurality of column electrodes with a third set of column drive signals and at substantially the same time driving said three or more row electrodes with a third set of row drive signals.

14. A method as claimed in claim 1, wherein said emissive display is an OLED display.

15. A method of driving an emissive display according to claim 1, comprising a first method of providing a multi-colour organic electro-luminescent display with an increased lifetime, the display comprising a matrix of pixels, each pixel having at least three sub-pixels, wherein a first sub-pixel comprises a sub-pixel of a first colour, a second sub-pixel comprises a sub-pixel of a second colour and a third sub-pixel comprises a sub-pixel of a third colour overlapping said first colour and said second colour, the first method comprising determining the light output of the third sub-pixel as a component of the light output of the first sub-pixel and a component of the light output of the second sub-pixel, determining the maximum portion of light output emitable for a given colour using said third sub-pixel and subtracting the corresponding light output components from the first sub-pixel light output and the second subpixel light output.

16. A carrier carrying processor control code to implement the method of claim 1.

17. An OLED display driver comprising means to implement the method of claim 1.

18. An emissive display driver for driving an emissive display comprising a plurality of pixels each addressable by a row electrode and a column electrode, said display driver comprising:

means for driving a plurality of said column electrodes with a first set of column drive signals;

means for driving a first group of two or more of said row electrodes with a first set of forward bias row drive signals at the same time as said column electrode driving with said first column drive signals, wherein said first set of forward bias row drive signals is to cause a plurality of pixels in each of two or more rows of the display to emit light at the same time;

means for driving said plurality of column electrodes with a second set of column drive signals;

means for driving a second group of two or more row electrodes with a second set of forward bias row drive signals at the same time as said column electrode driving with said second column drive signals, wherein said second set of forward bias row drive signals is to cause pixels in two or more rows of the display to emit light at the same time; and means for selecting row electrodes of said first group of two or more row electrodes based on correlation or expected correlation between rows of image data and for selecting row electrodes of said second group of row electrodes based on correlation or expected correlation between rows of image data, wherein the means for selecting is for selection of said first and second column drive signals and said row electrodes of said first and second groups such that a desired luminescence of said OLED pixels driven by said row and column electrodes is obtained by a substantially linear sum of luminances determined by said second row and column drive signals and to thereby build up a luminescence profile of a said row over a plurality of row scan periods.

19. An emissive display driver of claim 18, comprising an emissive display driver circuit for driving an emissive display, said display driver circuit comprising:

one or more column drivers to simultaneously drive a plurality of said column electrodes; and one or more row drivers to simultaneously drive a plurality of said row electrodes corresponding to said column electrodes at the same time as said column electrode driving, such that a drive for a said column electrode is shared between a plurality of said row drivers.

20. An emissive display driver as claimed in claim 18 wherein said row and column drivers comprise circuits to provide a controllable substantially constant current.

21. An emissive display driver as claimed in claim 18, wherein said emissive display is an OLED display.

22. An emissive display driver of claim 18, comprising an integrated circuit die chip comprising a plurality of drivers configured to drive a plurality of electrodes of an OLED display simultaneously, and display drive processing circuitry configured to determine drive signals for said plurality of electrodes; and wherein said die has an aspect ratio of greater than 10 to 1 length to breadth.

23. An emissive display driver as claimed in claim 18, wherein said row and column drivers comprise circuits to provide a controllable substantially constant current.

* * * * *

UNITED STATES PATENT AND TRADEMARK OFFICE

CERTIFICATE OF CORRECTION

PATENT NO. : 8,115,704 B2
APPLICATION NO. : 10/578941
DATED : February 14, 2012
INVENTOR(S) : Euan C. Smith et al.

It is certified that error appears in the above-identified patent and that said Letters Patent is hereby corrected as shown below:

In column 22, line 57, in Claim 7, delete "claimed claim" and insert -- claimed in claim --, therefor.

In column 23, line 42, in Claim 15, delete "subpixel" and insert -- sub-pixel --, therefor.

Signed and Sealed this
Fifteenth Day of May, 2012

David J. Kappos

David J. Kappos
*Director of the United States Patent and Trademark Office*